US008237638B2

(12) United States Patent
Smith et al.

(10) Patent No.: US 8,237,638 B2
(45) Date of Patent: Aug. 7, 2012

(54) MULTI-LINE ADDRESSING METHODS AND APPARATUS

(75) Inventors: Euan Christopher Smith, Cambridgeshire (GB); Nicholas Lawrence, Cambridge (GB)

(73) Assignee: Cambridge Display Technology Limited (GB)

( * ) Notice: Subject to any disclaimer, the term of this patent is extended or adjusted under 35 U.S.C. 154(b) by 1194 days.

(21) Appl. No.: 10/578,786

(22) PCT Filed: Sep. 29, 2005

(86) PCT No.: PCT/GB2005/050169

§ 371 (c)(1),
(2), (4) Date: May 9, 2006

(87) PCT Pub. No.: WO2006/035248

PCT Pub. Date: Apr. 6, 2006

(65) Prior Publication Data

US 2007/0069992 A1 Mar. 29, 2007

(30) Foreign Application Priority Data

Sep. 30, 2004 (GB) ..... 0421712.1

(51) Int. Cl.
*G09G 3/32* (2006.01)

(52) U.S. Cl. ..... 345/82

(58) Field of Classification Search ..... 345/204–215, 345/82; 340/815; 315/194–200
See application file for complete search history.

(56) References Cited

U.S. PATENT DOCUMENTS

| | | | |
|---|---|---|---|
| 3,621,321 | A | 11/1971 | Williams et al. |
| 4,539,507 | A | 9/1985 | VanSlyke et al. |
| 4,672,265 | A | 6/1987 | Eguchi et al. |
| 5,172,108 | A | 12/1992 | Wakabayashi et al. |
| 5,247,190 | A | 9/1993 | Friend et al. |
| 5,646,652 | A | 7/1997 | Saidi |
| 5,654,734 | A | 8/1997 | Orlen et al. |
| 5,684,502 | A | 11/1997 | Fukui et al. |
| 5,747,182 | A | 5/1998 | Friend et al. |
| 5,807,627 | A | 9/1998 | Friend et al. |

(Continued)

FOREIGN PATENT DOCUMENTS

EP 0541295 A2 5/1993

(Continued)

OTHER PUBLICATIONS

Lee, Daniel D., et al., "Algorithms for Non-negative Matrix Factorization", *Advances in Neural Information Processing Systems*, vol. 13, (2001), 556-562.

(Continued)

*Primary Examiner* — Chanh Nguyen
*Assistant Examiner* — Robert Stone
(74) *Attorney, Agent, or Firm* — Schwegman, Lundberg & Woessner, P.A.

(57) ABSTRACT

A method of driving an electro-optic display, the display having a plurality of pixels each addressable by a row electrode and a column electrode, the method including: receiving image data for display, the image data defining an image matrix; factorizing the image matrix into a product of at least first and second factor matrices, the first factor matrix defining row drive signals for the display, the second factor matrix defining column drive signals for the display; and driving the display row and column electrodes using the row and column drive signals respectively defined by the first and second factor matrices.

22 Claims, 20 Drawing Sheets

U.S. PATENT DOCUMENTS

| | | | | |
|---|---|---|---|---|
| 5,821,690 | A | 10/1998 | Martens et al. | |
| 5,874,932 | A * | 2/1999 | Nagaoka et al. | 345/60 |
| 5,886,755 | A * | 3/1999 | Imoto et al. | 349/37 |
| 5,900,856 | A | 5/1999 | Lino et al. | |
| 5,965,901 | A | 10/1999 | Heeks et al. | |
| 6,014,119 | A | 1/2000 | Staring et al. | |
| 6,054,974 | A | 4/2000 | Sakai et al. | |
| 6,151,414 | A | 11/2000 | Lee et al. | |
| 6,201,520 | B1 | 3/2001 | Iketsu et al. | |
| 6,332,661 | B1 | 12/2001 | Yamaguchi | |
| 6,366,026 | B1 | 4/2002 | Saito et al. | |
| 6,429,601 | B1 | 8/2002 | Friend et al. | |
| 6,496,168 | B1 | 12/2002 | Tomida | |
| 6,501,226 | B2 | 12/2002 | Lai et al. | |
| 6,558,219 | B1 | 5/2003 | Burroughes et al. | |
| 6,558,818 | B1 | 5/2003 | Samuel et al. | |
| 6,605,823 | B1 | 8/2003 | Pichler et al. | |
| 6,678,319 | B1 * | 1/2004 | Jamali | 375/234 |
| 6,771,235 | B2 | 8/2004 | Ishizuka et al. | |
| 6,806,857 | B2 | 10/2004 | Sempel et al. | |
| 6,832,729 | B1 * | 12/2004 | Perry et al. | 235/472.01 |
| 6,897,473 | B1 | 5/2005 | Burroughes et al. | |
| 7,049,010 | B1 | 5/2006 | Holmes et al. | |
| 7,078,251 | B2 | 7/2006 | Burroughes et al. | |
| 7,125,952 | B2 | 10/2006 | O'Dell et al. | |
| 7,151,341 | B2 | 12/2006 | Pichler et al. | |
| 7,327,358 | B2 | 2/2008 | Tajiri et al. | |
| 8,115,704 | B2 | 2/2012 | Smith et al. | |
| 2001/0040536 | A1 | 11/2001 | Tajima et al. | |
| 2002/0024513 | A1 | 2/2002 | Kota et al. | |
| 2002/0033782 | A1 | 3/2002 | Ogusu et al. | |
| 2002/0054266 | A1 | 5/2002 | Nishimura | |
| 2002/0063671 | A1 | 5/2002 | Knapp | |
| 2002/0083655 | A1 | 7/2002 | Paul et al. | |
| 2002/0097211 | A1 | 7/2002 | Yasunishi et al. | |
| 2002/0158832 | A1 | 10/2002 | Park et al. | |
| 2003/0018604 | A1 * | 1/2003 | Franz et al. | 707/1 |
| 2003/0030608 | A1 | 2/2003 | Kurumisawa et al. | |
| 2003/0048238 | A1 | 3/2003 | Tsuge et al. | |
| 2003/0128225 | A1 | 7/2003 | Credelle et al. | |
| 2003/0189579 | A1 * | 10/2003 | Pope | 345/660 |
| 2003/0193463 | A1 | 10/2003 | Yamada et al. | |
| 2004/0021654 | A1 * | 2/2004 | Mas et al. | 345/204 |
| 2004/0066363 | A1 * | 4/2004 | Yamano et al. | 345/98 |
| 2004/0125046 | A1 | 7/2004 | Yamazaki et al. | |
| 2004/0145553 | A1 | 7/2004 | Sala et al. | |
| 2004/0150608 | A1 | 8/2004 | Kim et al. | |
| 2004/0169463 | A1 | 9/2004 | Burn et al. | |
| 2004/0249615 | A1 | 12/2004 | Grzeszczuk et al. | |
| 2005/0021333 | A1 * | 1/2005 | Smaragdis | 704/236 |
| 2005/0057462 | A1 | 3/2005 | Kota et al. | |
| 2005/0110720 | A1 | 5/2005 | Akimoto et al. | |
| 2005/0123053 | A1 * | 6/2005 | Cooper et al. | 375/240.24 |
| 2005/0190119 | A1 | 9/2005 | Yamazaki et al. | |
| 2005/0218791 | A1 | 10/2005 | Kawase | |
| 2006/0001613 | A1 | 1/2006 | Routley et al. | |
| 2006/0050032 | A1 | 3/2006 | Gunner et al. | |
| 2006/0214890 | A1 | 9/2006 | Morishige et al. | |
| 2007/0046603 | A1 * | 3/2007 | Smith et al. | 345/90 |
| 2007/0076869 | A1 * | 4/2007 | Mihcak et al. | 380/54 |
| 2007/0085779 | A1 * | 4/2007 | Smith et al. | 345/76 |
| 2008/0246703 | A1 * | 10/2008 | Smith | 345/80 |
| 2008/0291122 | A1 * | 11/2008 | Smith et al. | 345/55 |
| 2009/0128459 | A1 * | 5/2009 | Smith et al. | 345/80 |
| 2009/0128571 | A1 * | 5/2009 | Smith et al. | 345/519 |

FOREIGN PATENT DOCUMENTS

| | | | | |
|---|---|---|---|---|
| EP | 0581255 | A1 | 2/1994 | |
| EP | 0621578 | A | 10/1994 | |
| EP | 0678844 | A1 | 10/1995 | |
| EP | 1079361 | A | 2/2001 | |
| EP | 1091339 | A2 | 4/2001 | |
| EP | 1408479 | A2 | 4/2004 | |
| EP | 1457958 | A2 | 9/2004 | |
| GB | 2371910 | A | 8/2002 | |
| GB | 2381643 | A | 5/2003 | |
| GB | P85906 | * | 7/2003 | |
| GB | 2388236 | A | 11/2003 | |
| GB | 2388236 | A1 | 11/2003 | |
| GB | 2389951 | A | 12/2003 | |
| GB | 2389952 | * | 12/2003 | 345/76 |
| GB | 2389952 | A1 | 12/2003 | |
| JP | 10-20809 | A | 1/1998 | |
| JP | 10-260659 | A | 9/1998 | |
| JP | 2002-258805 | A | 9/2002 | |
| JP | 2002-342842 | A | 11/2002 | |
| JP | 2003-084732 | A | 3/2003 | |
| JP | 2003-108082 | A | 4/2003 | |
| JP | 2004-133138 | A | 4/2004 | |
| WO | WO-9013148 | A1 | 11/1990 | |
| WO | WO-94/27276 | A1 | 11/1994 | |
| WO | WO-95/04986 | A1 | 2/1995 | |
| WO | WO-9506400 | A1 | 3/1995 | |
| WO | WO-9921935 | | 5/1999 | |
| WO | WO-9948160 | A1 | 9/1999 | |
| WO | WO-02067343 | A1 | 8/2002 | |
| WO | WO-03079322 | A1 | 9/2003 | |
| WO | WO-03/094140 | A1 | 11/2003 | |
| WO | WO-03091983 | A1 | 11/2003 | |
| WO | WO 2004/001707 | A2 | 12/2003 | |
| WO | WO-2004001707 | A2 | 12/2003 | |
| WO | WO-2004003877 | A2 | 1/2004 | |
| WO | WO-2006035246 | A1 | 4/2006 | |
| WO | WO-2006035248 | A1 | 4/2006 | |

OTHER PUBLICATIONS

Lee, Daniel D., et al., "Learning the parts of objects by nan-negative matrix factorization", *Nature*, vol. 401 (Oct. 1991), 788-791.

Lui, Wenguo, et al., "Existing and new algorithms for non-negative matrix factorization", http://www.cs.utexas.edu/users/liuwg/383Cproject/CS_383C_Project.htm, (2002).

Shahnaz, Farial, et al., "Document clustering using nonnegative matrix factorization", *Information Processing and Management*, (2004), 14 Pages.

Tangsrirat, W., et al., "FTFN with Variable current gain", *Proceedings of IEEE Region 10 International Conference on Electrical and Electronic Technology, 2001. TENCON.*, vol. 1, (2001), 209-212.

Vogt, Frank, et al., "Recent advancements in chemometrics for smart sensors", *Analyst*, vol. 129, (2004), 492-502.

"International Search Report and Written Opinion for Application No. PCT/GB2005/050169", 6 pages.

"United Kingdom Search Report for Application No. GB0421712.1", 1 Page.

International Preliminary Report on Patentability for corresponding PCT applicaiton No. PCT/GB2005/050169, Date of Mailing Apr. 12, 2007, 10 pages.

"U.S. Appl. No. 10/578,659, Notice of Allowance mailed Jun. 24, 2010", 9 pgs.

"U.S. Appl. No. 10/578,941, Final Office Action mailed Jul. 12, 2010", 19 pgs.

"U.S. Appl. No. 10/578,941, Preliminary Amendment filed May 9, 2006", 9 pgs.

"U.S. Appl. No. 10/578,659 , Notice of Allowance mailed Jun. 24, 2010", 10 pgs.

Routley, P. R., et al., "Display Driver Circuits", Great Britain Application Serial No. GB20020013989.7, filed Jun. 18, 2002, 56 pgs.

"U.S. Appl. No. 10/578,659, Preliminary Amendment filed May 9, 2006", 14 pgs.

"U.S. Appl. No. 10/578,941, Notice of Allowance mailed Jun. 27, 2011", 5 pgs.

"Japanese Application Serial No. 2007-534097, Office Action mailed May 24, 2011", (English Translation), 8 pgs.

Yamaguchi, K., et al., "An Initialization Method for Non-negative Matrix Factorization and its Application", (w/English Abstract), *IEICE Transactions on Information and Systems*, Pt. 2 (Japanese Edition), vol. J87-D-II, No. 3, (Mar. 2004), 923-928.

"U.S. Appl. No. 10/578,659, Notice of Allowance mailed Jan. 27, 2011", 9 pgs.

"U.S. Appl. No. 10/578,941, Response filed Oct. 12, 2010 to Final Office Action maied Jul. 12, 2010", 15 pgs.

"U.S. Appl. No. 10/578,659, Non-Final Office Action mailed Nov. 12, 2009", 37 pgs.
"U.S. Appl. No. 10/578,659, Response filed Mar. 12, 2010 to Non-Final Office Action mailed Nov. 12, 2009", 18 pgs.
"U.S. Appl. No. 10/578,659, Response filed Mar. 31, 2009 to Restriction Requirement mailed Feb. 3, 2009", 15 pgs.
"U.S. Appl. No. 10/578,659, Response filed Sep. 16, 2009 to Restriction Requirement mailed Jul. 17, 2009", 14 pgs.
"U.S. Appl. No. 10/578,659, Restriction Requirement mailed Feb. 3, 2009", 7 pgs.
"U.S. Appl. No. 10/578,659, Restriction Requirement mailed Jul. 17, 2009", 6 pgs.
"U.S. Appl. No. 10/578,941, Final Office Action mailed Aug. 5, 2009", 19 pgs.
"U.S. Appl. No. 10/578,941, Non-Final Office Action mailed Jan. 21, 2010", 20 pgs.
"U.S. Appl. No. 10/578,941, Non-Final Office Action mailed Dec. 23, 2008", 36 pgs.
"U.S. Appl. No. 10/578,941, Preliminary Amendment filed Mar. 23, 2007", 3 pgs.
"U.S. Appl. No. 10/578,941, Response filed Apr. 21, 2009 to Non-Final Office Action mailed Dec. 23, 2008", 18 pgs.
"U.S. Appl. No. 10/578,941, Response filed Oct. 27, 2009 to Final Office Action mailed Aug. 5, 2009", 11 pgs.
"U.S. Appl. No. 10/578,941, Response filed Apr. 22, 2010 to Non-Final Office Action mailed Jan. 21, 2010", 11 pgs.
"International Application No. PCT/GB2005/050167, International Search Report mailed Jan. 17, 2007", 2 pgs.
"International Application No. PCT/GB2005/050167, Written Opinion mailed Jan. 17, 2007", 7 pgs.
"International Application No. PCT/GB2005/050219, International Search Report mailed Feb. 20, 2008", 3 pgs.
"International Application No. PCT/GB2005/050219, Written Opinion Feb. 20, 2008", 17 pgs.
"United Kingdom Search Report for Application No. GB0524337.3", 1 Page, Mar. 17, 2006.
Berry, M. W., et al., "Algorithms and Applications for Approximate Nonnegative Matrix Factorization", *Computational Statistics & Data Analysis*, 52, (2007), 155-173.
Chu, M., et al., "Optimality, Computation, and Interpretation of Nonnegative Matrix Factorizations", [online}. Version: Oct. 18, 2004. [retrieved Feb. 6, 2008]. Retrieved from the Internet: <URL: http://www.wfu.edu/{plemmons/papers/chu_ple.pdf>, 18 pgs.
Eisenbrand, F., et al., "Algorithms for Longer OLED Lifetime", *Proceedings, 6th Workshop on Experimental Algorithms* (*WEA 2007*), *Lecture Notes in Computer Science*, vol. 4525, (2007), 338-351.
Guillamet, D., et al., "Non-negative Matrix Factorizeration for Face Recognition", *Lecture Notes in Computer Science*, vol. 2504/2002—*Topics in Artificial Intelligence: 5th Catalonian Conference on AI*(*CCIA 2002*), (2002), 336-344.
Smith, E. C., "8.3: Total Matrix Addressing (TMA tm)", *International Symposium Digest of Technical Papers* (*SID 2007*), (2007), 93-96.
Tropp, J. A., "Literature Survery: Non-Negative Matrix Factorization", [online]. Preprint, University of Texas at Austin. [retrieved Feb. 7, 2008]. Retrieved from the Internet: <URL: http://www.acm.caltech.edu/{jtropp/notes/Tro03-Literature-Survey.pdf>, (2003), 10 pgs.
"U.S. Appl. No. 10/578,941, Notice of Allowance mailed Oct. 4, 2011", 5 pgs.

* cited by examiner

300

MULTI-LINE ADDRESSING METHODS AND APPARATUS

CLAIM OF PRIORITY

This application is a U.S. National Stage Filing under 35 U.S.C. 371 from International Patent Application No. PCT/GB2005/050169 filed Sep. 29, 2005 and published as WO 2006/035248 A1 on Apr. 6, 2006, which claimed priority under 35 U.S.C. 119 to United Kingdom Application No. 0421712.1, filed Sep. 30, 2004, which applications and publication are incorporated herein by reference and made a part hereof; and applicant further claims priority under 35 USC 119 to Great Britain Application No. 0428191.1, filed 23 Dec. 2004; and to Great Britain Application No. 0506973.7, filed 6 Apr. 2005.

This invention relates to methods and apparatus for driving electro-optic, in particular organic light emitting diodes (OLED) displays using multi-line addressing (MLA) techniques. Embodiments of the invention are particularly suitable for use with so-called passive matrix OLED displays. This application is one of a set of three related applications sharing the same priority date.

BACKGROUND

Multi-line addressing techniques for liquid crystal displays (LCDs) have been described, for example in US2004/150608, US2002/158832 and US2002/083655, for reducing power consumption and increasing the relatively slow response rate of LCDs. However these techniques are not suitable for OLED displays because of differences stemming from the fundamental difference between OLEDs and LCDs that the former is an emissive technology whereas the latter is a form of modulator. Furthermore, an OLED provides a substantially linear response with applied current and whereas an LCD cell has a non-linear response which varies according to the RMS (root-mean-square) value of the applied voltage.

Displays fabricated using OLEDs provide a number of advantages over LCD and other flat panel technologies. They are bright, colourful, fast-switching (compared to LCDs), provide a wide viewing angle and are easy and cheap to fabricate on a variety of substrates. Organic (which here includes organometallic) LEDs may be fabricated using materials including polymers, small molecules and dendrimers, in a range of colours which depend upon the materials employed. Examples of polymer-based organic LEDs are described in WO 90/13148, WO 95/06400 and WO 99/48160; examples of dendrimer-based materials are described in WO 99/21935 and WO 02/067343; and examples of so called small molecule based devices are described in U.S. Pat. No. 4,539,507.

A typical OLED device comprises two layers of organic material, one of which is a layer of light emitting material such as a light emitting polymer (LEP), oligomer or a light emitting low molecular weight material, and the other of which is a layer of a hole transporting material such as a polythiophene derivative or a polyaniline derivative.

Organic LEDs may be deposited on a substrate in a matrix of pixels to form a single or multi-colour pixellated display. A multicoloured display may be constructed using groups of red, green, and blue emitting pixels. So-called active matrix displays have a memory element, typically a storage capacitor and a transistor, associated with each pixel whilst passive matrix displays have no such memory element and instead are repetitively scanned to give the impression of a steady image. Other passive displays include segmented displays in which a plurality of segments share a common electrode and a segment may be lit up by applying a voltage to its other electrode. A simple segmented display need not be scanned but in a display comprising a plurality of segmented regions the electrodes may be multiplexed (to reduce their number) and then scanned.

FIG. 1*a* shows a vertical cross section through an example of an OLED device 100. In an active matrix display part of the area of a pixel is occupied by associated drive circuitry (not shown in FIG. 1*a*). The structure of the device is somewhat simplified for the purposes of illustration.

The OLED 100 comprises a substrate 102, typically 0.7 mm or 1.1 mm glass but optionally clear plastic or some other substantially transparent material. An anode layer 104 is deposited on the substrate, typically comprising around 150 nm thickness of ITO (indium tin oxide), over part of which is provided a metal contact layer. Typically the contact layer comprises around 500 nm of aluminium, or a layer of aluminium sandwiched between layers of chrome, and this is sometimes referred to as anode metal. Glass substrates coated with ITO and contact metal are available from Corning, USA. The contact metal over the ITO helps provide reduced resistance pathways where the anode connections do not need to be transparent, in particular for external contacts to the device. The contact metal is removed from the ITO where it is not wanted, in particular where it would otherwise obscure the display, by a standard process of photolithography followed by etching.

A substantially transparent hole transport layer 106 is deposited over the anode layer, followed by an electroluminescent layer 108, and a cathode 110. The electroluminescent layer 108 may comprise, for example, a PPV (poly(p-phenylenevinylene)) and the hole transport layer 106, which helps match the hole energy levels of the anode layer 104 and electroluminescent layer 108, may comprise a conductive transparent polymer, for example PEDOT:PSS (polystyrene-sulphonate-doped polyethylene-dioxythiophene) from Bayer AG of Germany. In a typical polymer-based device the hole transport layer 106 may comprise around 200 nm of PEDOT; a light emitting polymer layer 108 is typically around 70 nm in thickness. These organic layers may be deposited by spin coating (afterwards removing material from unwanted areas by plasma etching or laser ablation) or by inkjet printing. In this latter case banks 112 may be formed on the substrate, for example using photoresist, to define wells into which the organic layers may be deposited. Such wells define light emitting areas or pixels of the display.

Cathode layer 110 typically comprises a low work function metal such as calcium or barium (for example deposited by physical vapour deposition) covered with a thicker, capping layer of aluminium. Optionally an additional layer may be provided immediately adjacent the electroluminescent layer, such as a layer of lithium fluoride, for improved electron energy level matching. Mutual electrical isolation of cathode lines may achieved or enhanced through the use of cathode separators (not shown in FIG. 1*a*).

The same basic structure may also be employed for small molecule and dendrimer devices. Typically a number of displays are fabricated on a single substrate and at the end of the fabrication process the substrate is scribed, and the displays separated before an encapsulating can is attached to each to inhibit oxidation and moisture ingress.

To illuminate the OLED power is applied between the anode and cathode, represented in FIG. 1*a* by battery 118. In the example shown in FIG. 1*a* light is emitted through transparent anode 104 and substrate 102 and the cathode is generally reflective; such devices are referred to as "bottom emitters". Devices which emit through the cathode ("top emitters") may also be constructed, for example by keeping the thickness of cathode layer 110 less than around 50-100 nm so that the cathode is substantially transparent.

Organic LEDs may be deposited on a substrate in a matrix of pixels to form a single or multi-colour pixellated display. A multicoloured display may be constructed using groups of red, green, and blue emitting pixels. In such displays the individual elements are generally addressed by activating row (or column) lines to select the pixels, and rows (or columns) of pixels are written to, to create a display. So-called active matrix displays have a memory element, typically a storage capacitor and a transistor, associated with each pixel whilst passive matrix displays have no such memory element and instead are repetitively scanned, somewhat similarly to a TV picture, to give the impression of a steady image.

Referring now to FIG. 1*b*, this shows a simplified cross-section through a passive matrix OLED display device 150, in which like elements to those of FIG. 1*a* are indicated by like reference numerals. As shown the hole transport 106 and electroluminescent 108 layers are subdivided into a plurality of pixels 152 at the intersection of mutually perpendicular anode and cathode lines defined in the anode metal 104 and cathode layer 110 respectively. In the figure conductive lines 154 defined in the cathode layer 110 run into the page and a cross-section through one of a plurality of anode lines 158 running at right angles to the cathode lines is shown. An electroluminescent pixel 152 at the intersection of a cathode and anode line may be addressed by applying a voltage between the relevant lines. The anode metal layer 104 provides external contacts to the display 150 and may be used for both anode and cathode connections to the OLEDs (by running the cathode layer pattern over anode metal lead-outs). The above mentioned OLED materials, in particular the light emitting polymer and the cathode, are susceptible to oxidation and to moisture and the device is therefore encapsulated in a metal can 111, attached by UV-curable epoxy glue 113 onto anode metal layer 104, small glass beads within the glue preventing the metal can touching and shorting out the contacts.

Referring now to FIG. 2, this shows, conceptually, a driving arrangement for a passive matrix OLED display 150 of the type shown in FIG. 1*b*. A plurality of constant current generators 200 are provided, each connected to a supply line 202 and to one of a plurality of column lines 204, of which for clarity only one is shown. A plurality of row lines 206 (of which only one is shown) is also provided and each of these may be selectively connected to a ground line 208 by a switched connection 210. As shown, with a positive supply voltage on line 202, column lines 204 comprise anode connections 158 and row lines 206 comprise cathode connections 154, although the connections would be reversed if the power supply line 202 was negative and with respect to ground line 208.

As illustrated pixel 212 of the display has power applied to it and is therefore illuminated. To create an image connection 210 for a row is maintained as each of the column lines is activated in turn until the complete row has been addressed, and then the next row is selected and the process repeated. Preferably, however, to allow individual pixels to remain on for longer and hence reduce overall drive level, a row is selected and all the columns written in parallel, that is a current driven onto each of the column lines simultaneously to illuminate each pixel in a row at its desired brightness. Each pixel in a column could be addressed in turn before the next column is addressed but this is not preferred because, inter alia, of the effect of column capacitance.

The skilled person will appreciate that in a passive matrix OLED display it is arbitrary which electrodes are labelled row electrodes and which column electrodes, and in this specification "row" and "column are used interchangeably.

It is usual to provide a current-controlled rather than a voltage-controlled drive to an OLED because the brightness of an OLED is determined by the current flowing through the device, this determining the number of photons it generates. In a voltage-controlled configuration the brightness can vary across the area of a display and with time, temperature, and age, making it difficult to predict how bright a pixel will appear when driven by a given voltage. In a colour display the accuracy of colour representations may also be affected.

The conventional method of varying pixel brightness is to vary pixel on-time using Pulse Width Modulation (PWM). In a conventional PWM scheme a pixel is either full on or completely off but the apparent brightness of a pixel varies because of integration within the observer's eye. An alternative method is to vary the column drive current.

FIG. 3 shows a schematic diagram 300 of a generic driver circuit for a passive matrix OLED display according to the prior art. The OLED display is indicated by dashed line 302 and comprises a plurality n of row lines 304 each with a corresponding row electrode contact 306 and a plurality m of column lines 308 with a corresponding plurality of column electrode contacts 310. An OLED is connected between each pair of row and column lines with, in the illustrated arrangement, its anode connected to the column line. A y-driver 314 drives the column lines 308 with a constant current and an x-driver 316 drives the row lines 304, selectively connecting the row lines to ground. The y-driver 314 and x-driver 316 are typically both under the control of a processor 318. A power supply 320 provides power to the circuitry and, in particular, to y-driver 314.

Some examples of OLED display drivers are described in U.S. Pat. No. 6,014,119, U.S. Pat. No. 6,201,520, U.S. Pat. No. 6,332,661, EP 1,079,361A and EP 1,091,339A and OLED display driver integrated circuits employing PWM are sold by Clare Micronix of Clare, Inc., Beverly, Mass., USA. Some examples of improved OLED display drivers are described in the Applicant's co-pending applications WO 03/079322 and WO 03/091983. In particular WO 03/079322, hereby incorporated by reference, describes a digitally controllable programmable current generator with improved compliance.

Overview

There is a continuing need for techniques which can improve the lifetime of an OLED display. There is a particular need for techniques which are applicable to passive matrix displays since these are very much cheaper to fabricate than active matrix displays. Reducing the drive level (and hence brightness) of an OLED can significantly enhance the lifetime of the device—for example halving the drive/brightness of the OLED can increase its lifetime by approximately a factor of four. The inventors have recognised that multi-line addressing techniques can be employed to reduce peak display drive levels, in particular in passive matrix OLED displays, and hence increase display lifetime.

MLA Addressing with Matrix Decomposition

According to a first aspect of the present invention there is therefore provided a method of driving an electro-optic display, the display having a plurality of pixels each addressable by a row electrode and a column electrode, the method comprising: receiving image data for display, said image data defining an image matrix; factorising said image matrix into a product of at least first and second factor matrices, said first factor matrix defining row drive signals for said display, said second factor matrix defining column drive signals for said display; and driving said display row and column electrodes using said row and column drive signals respectively defined by said first and second factor matrices.

In embodiments of this method factorising the image matrix into at least two factor matrices defining row and column drive signals for the display (which in embodiments may be scaled as described later) enables the drive to pixels of the display to be spread over a longer time interval, thus reducing the maximum pixel drive for a given apparent brightness, taking into account integration within a viewer's eye. Thus preferably the driving comprises driving a plurality of the row electrodes in combination with a plurality of the column electrodes. In this way advantage may be taken of correlations between the luminescence of pixels in different rows to build the required luminescent profile of each line or row of the display over a plurality of lines scan periods, rather than as an impulse in a single line scan period. Some benefit can be obtained even when the total number of line scan periods is the same as for a conventionally line-by-line scanned display.

In preferred embodiments neither of the first and second factor matrices is predefined or predetermined. Instead both the first and second factor matrices for each new image, that is they are re-calculated for each block of image data received defining an image for display.

Preferably therefore the method drives the display with successive sets of row and column signals to build up a displayed image, each set of signals defining a subframe of the displayed image, the subframes combining to define the complete desired image. Here a subframe may refer to a portion of the desired displayed image in either time and/or space but in preferred embodiments the subframes are displayed during successive time intervals, for example each analogous to a conventional line scan period, so that when rapidly successively displayed the desired pixel brightnesses are obtained.

As will be seen later, in embodiments of the method the image matrix factorisation can incorporate a degree of compression which allows essentially the same information (that is compressed to an acceptable degree) to be displayed in a shorter time or, equivalently, over the same period of time as a conventional frame period but with a reduced drive to each pixel, each line or row effectively being driven for a longer period than in a conventional display. In a colour display where the colour channels are processed (factorised) separately different degrees of compression may be applied to the different colour channels. In this case it is preferable to apply less compression to the green channel (of an RBG display) as the human eye is more sensitive to differences (errors or noise) in green level than to differences in red or blue levels.

In embodiments the number of subframes is no greater than the lesser of the number of rows and the number of columns of the display; preferably the number of subframes is less than the smaller of the number of rows and the number of columns. In some applications the flexibility to define arbitrarily what is a row and what is a column of the display may be limited by, for example, a desire for compatibility with existing designs, in which case the number of subframes is preferably no greater than (and preferably less than) either the number of rows or the number of columns of the display. Displays are envisaged in which each pixel (or sub-pixel of a colour display) is addressed by a corresponding row and column electrode and hence references to row and columns of the display can be understood as references to row and column electrodes of the display.

In embodiments of the method the first factor matrix has dimensions determined by the number of row electrodes and a number of subframes employed (which may be predetermined by hardware and/or software or which may be selectable dependent upon, say, display quality). Similarly, the second factor matrix has dimensions determined by the number of column electrodes and the number of subframes. As previously mentioned, preferably the first and second factor matrices are configured, for example by limiting the number of subframes or dimensions of the matrices, such that a peak pixel brightness of the display is reduced compared with row-by-row driving of the same display using the same image data (with the same overall frame period to display a substantially complete image from the received data). Reducing the peak pixel brightness, that is reducing the peak pixel drive, increases the overall display lifetime. Again, in an RBG display more subframes may be employed for one colour, in particular green, than another, to provide increased accuracy of green (as opposed to blue or red) rendering.

Broadly speaking the dynamic range of pixel drive/brightness is reduced by reducing the higher pixel drive signals and this increases display lifetime roughly proportionately. This is because the lifetime reduces with the square of the pixel drive (brightness) but the length of time for which a pixel must be driven to provide the same apparent brightness to an observer increases only substantially linearly with decreasing pixel drive.

In some embodiments of the method the matrix factorising comprises singular value decomposition (SVD) into three factor matrices, the first and second factor matrices and a third factor matrix, the third factor matrix being substantially diagonal (with positive or zero elements defining so-called singular values). In this case the row drive signals are defined by a combination of the first and third factor matrices and the column drive signals by a combination of the second and third factor matrices. Since these combinations give rise to matrices with either positive or negative elements embodiments of this method are best suited to liquid crystal displays (LCDs) rather than to electroluminescent displays such as OLED display. However an SVD-based method may, for example, be incorporated into an iterative scheme which forces non-negative (i.e. positive or zero) valued elements.

With SVD matrix factorisation the diagonal elements of the third matrix effectively define a weight for the corresponding values in the first and second factor matrices and thus this provides a straightforward method for, in effect, compressing the image data by reducing the number of subframes displayed. Thus in embodiments of this method selective driving of the display is employed in which row and column drive signals defined by diagonal values of the third factor matrix less than a threshold value are neglected, in effect compressing the drive signals dependent upon a threshold of the diagonal values of the third factor matrix.

In a colour display in which, say, separate factorisation is applied to red, green and blue colour channels, it is preferably to give the green channel a greater weight than the others, for example by using a lower threshold value for green or by scaling the colour channel information using respective colour channel weights before the factorisation and then scaling the results back or performing an inverse scaling operation after factorisation. An alternative approach is to weight individual red, green and blue data values differently during the factorisation procedure (which is generally applied to a single image data matrix for the combined colour channels). In practice this comprises multiplying the green data values by a greater-than-unity scaling factor (and dividing by a total weight) during the factorisation. This is mathematically equivalent to scaling up before and back after factorisation, but can reduce rounding errors where, for example, a fixed number of bits integer-type (rather than floating point) representation is employed.

Similar techniques can be employed with other factorisation methods such as the non-negative matrix factorisation (NMF) mentioned below.

In other embodiments of the method the factorising comprises QR decomposition (into a triangular and an orthogonal matrix) or LU decomposition (into upper and lower triangular matrices). However in some further preferred embodiments the image matrix factorisation comprises non-negative matrix factorisation (NMF).

Broadly speaking in NMF the image matrix I (which is non-negative) is factorised into a pair of matrices W and H such that I is approximately equal to the product of W and H where W and H are chosen subject to the constraints that their elements are all equal to or greater than zero. A typical NMF algorithm iteratively updates W and H to improve the approximation by aiming to minimise a cost function such as the squared Eucliden distance between I and WH.

Non-negative matrix factorisation is particularly useful for driving an emissive display such as an electroluminescent display, in particular an OLED display, as a simple OLED cannot be driven to produce a "negative" luminescence, and it is therefore necessary, at least for driving a passive matrix OLED display, for the elements of the first and second factor matrices to be positive or zero.

The situation is different when driving LCD displays, and also when driving active matrix OLED displays in which the circuitry associated with a pixel is designed to allow both positive and negative drive inputs, for example adding or subtracting charge from a compacitor associated with a pixel in order that the light output is the sum or integral of a series of drive input signals.

In non-negative matrix factorisation (NMF) when matrix I has dimensions m×n (row×column) matrix W has dimension m×p and matrix H has dimensions p×n where p is generally chosen to be less than both n and m. Thus W and H are smaller than I, this resulting in a compression of the original image data. Broadly speaking W can be regarded as defining a basis for the linear approximation of the image data I and in many cases a good representation of I can be achieved with a relatively small number of basis vectors since images generally contain some inherent, correlated structure rather than purely random data. This image compression is useful as it enables the image to be displayed in a smaller number of row/column drive events than would otherwise be the case (for a conventional row-by-row raster scan). This in turn means that for the same frame period each pixel can be driven for longer thus reducing the pixel drive signal necessary for the same apparent pixel brightness, and hence increasing the display lifetime. In a large display such as an active matrix display with a very large number of pixels, for example 3000 by 2000 pixels, this technique also facilitates more rapid update of the displayed data. In some instances, for example where a predefined graphic icon or logo is being displayed, the matrix factorisation for at least this portion of the image can be pre-calculated and stored to speed up processing of images containing the logo or icon.

It is possible to order the columns in the row matrix (and the corresponding rows in the column matrix) to give the general appearance of a scanned display. This is because a pair of sets of elements comprising a row of the first factor matrix and column of the second factor matrix can be swapped with a corresponding pair without affecting the mathematical result. Sorting the matrices to give the appearance of a scanned display is useful because a computation of the image matrix factorisation can result in arbitrary ordering of drive signals to bright areas of the display, which may change from frame to frame and which can give rise to the appearance of motion artefacts or jitter. Sorting the data in the factor matrices so that bright areas of a displayed image are generally illuminated in a single direction, from top to bottom of the display, can reduce flicker.

In embodiments of the above described methods a pixel comprises red, green and blue subpixels but although the image data comprises data for each of these colour channels it is preferable that these are treated together as a single "combined" matrix. However it is then preferable that the factorising is performed subject to a constraint that the factorisation of the matrix for one channel, in particular the green, is on average more accurate than the factorisation of the matrices for the other colour channels. Thus, for example, more subframes may be used for the green channel, and/or a lower error threshold may be applied to the green channel processing, and/or a greater weight may be given to the green channel as compared with the red/blue channels and/or less relatively compression may be applied to the green channel. This is because, as mentioned previously, the human eye is more sensitive to differences (errors or noise) in green level than to differences in red or blue levels. Similar techniques may be applied in the other aspects of the invention mentioned below, and the invention also contemplates means to put the above-described green-channel processing techniques into effect in the context of the other aspects of the invention mentioned below.

According to a second aspect of the invention there is provided a method of driving an electro-optic display, the display having a plurality of pixels each addressable by a row electrode and a column electrode, the method comprising: receiving image data for display; formatting said image data into a plurality of subframes, each said subframe comprising data for driving a plurality of said row electrodes simultaneously with a plurality of said column electrodes; and driving said row and column electrodes with said subframe data.

In embodiments formatting the image data into a plurality of subframes enables the same pixels to be drive by two (or more) subframes and hence the peak drive to be reduced for the same apparent brightness, thus extending display lifetime. Preferably the formatting comprises compressing the image data into the plurality of subframes; in some embodiments some scaling of the image or subframe data may also be applied. The compressing may, as described above, employ singular value decomposition (SVD) or non-negative matrix factorisation (NMF).

Preferred embodiments of the above described methods are particularly useful for driving an organic light emitting diode display.

In a related aspect the invention provides a driver for an electro-optic display, the display having a plurality of pixels each addressable by a row electrode and a column electrode, the driver comprising; means for receiving image data for display, said image data defining an image matrix; means for factorising said image matrix into a product of at least first and second factor matrices, said first factor matrix defining row drive signals for said display, said second factor matrix defining column drive signals for said display; and means for outputting said row and column drive signals respectively defined by said first and second factor matrices.

The invention further provides a driver for an electro-optic display, the display having a plurality of pixels each addressable by a row electrode and a column electrode, the driver comprising: means for receiving image data for display;

means for formatting said image data into a plurality of subframes, each said subframe comprising data for driving a plurality of said row electrodes simultaneously with a plurality of said column electrodes; and means for outputting said subframe data for driving said row and column electrodes.

The invention further provides a driver for an electro-optic display, the display having a plurality of pixels each addressable by a row electrode and a column electrode, the driver comprising; an input to receive image data for display, said image data defining an image matrix; an output to provide data for driving said row and column electrodes of said display; data memory to store said image data; program memory storing processor implementable instructions; and a processor coupled to said input, to said output, to said data memory and to said program memory to load and implement said instructions, said instructions comprising instructions for controlling the processor to: input said image data; factorise said image matrix into a product of at least first and second factor matrices said first factor matrix defining row drive signals for said display, said second factor matrix defining column drive signals for said display; and output said row and column drive signals respectively defined by said first and second factor matrices.

The invention further provides a driver for an electro-optic display, the display having a plurality of pixels each addressable by a row electrode and a column electrode, the driver comprising; an input to receive image data for display, said image data defining an image matrix; an output to provide data for driving said row and column electrodes of said display; data memory to store said image data; program memory storing processor implementable instructions; and a processor coupled to said input, to said output, to said data memory and to said program memory to load and implement said instructions, said instructions comprising instructions for controlling the processor to: input said image data; format said image data into a plurality of subframes, each said subframe comprising data for driving a plurality of said row electrodes simultaneously with a plurality of said column electrodes; and output said subframe data for driving said row and column electrodes.

The invention further provides processor control code, and a carrier medium carrying the code to implement the above described methods and display drivers. This code may comprise conventional program code, for example for a digital signal processor (DSP), or microcode, or code for setting up or controlling an ASIC or FPGA, or code for a hardware description language such as Verilog™; such code may be distributed between a plurality of coupled components. The carrier medium may comprise any conventional storage medium such as a disk or programmed memory such as firmware, or a data carrier such as an optical medium.

BRIEF DESCRIPTION OF THE DRAWINGS

These and other aspects of the of the invention will now be further described, by way of example only, with the reference to the accompanying figures in which.

DETAILED DESCRIPTION

Figure 1A:
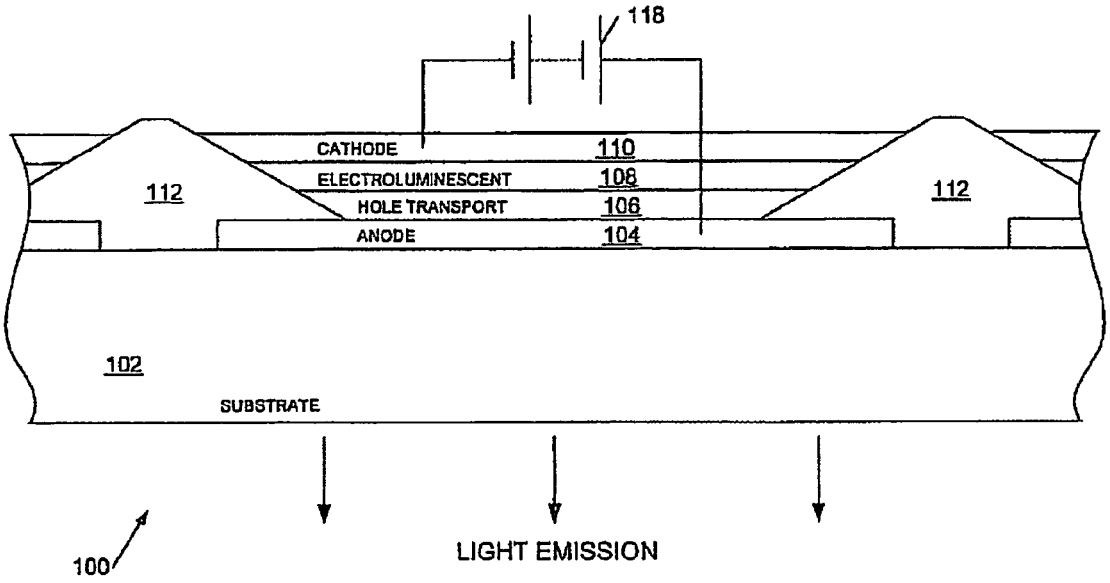
Figure 1a (PRIOR ART)
FIGS. 1*a* and 1*b* show, respectively, a vertical cross section through an OLED device, and a simplified cross section through a passive matrix OLED display.
Figure 1B:
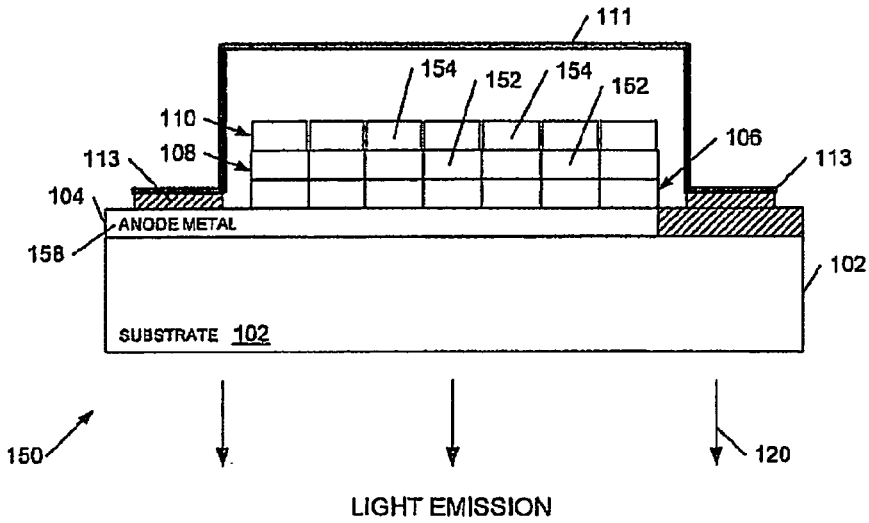
Figure 2:
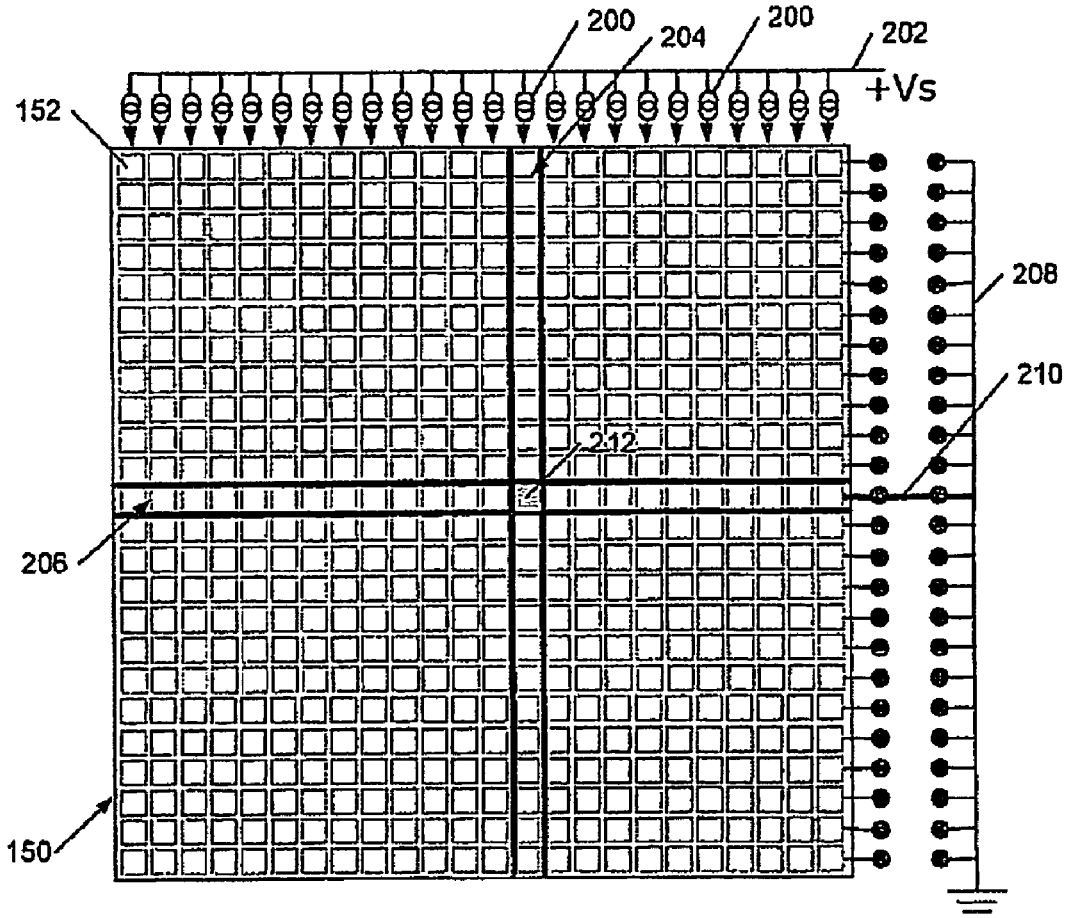
FIG. 2 shows conceptually a driving arrangement for a passive matrix OLED display.

Consider a pair of rows of a passive matrix OLED display comprising a first row A, and a second row B. In a conventional passive matrix drive scheme the rows would be driven as shown in table 1 below, with each row in either a fully-on state (1.0) or a fully-off state (0.0).

TABLE 1

| A | | B | |
|---|---|---|---|
| on | (1.0) | off | (0.0) |
| off | (0.0) | on | (1.0) |

Consider the ratio A/(A+B); in the example of Table 1 above this is either zero or one, but provided that a pixel in the same column in the two rows is not fully-on in both rows this ratio may be reduced whilst still providing the desired pixel luminances. In this way the peak drive level can be reduced and pixel lifetime increased.

In the first line scan the luminances might be:

| First period | | | | |
|---|---|---|---|---|
| 0.0 | 0.361 | 0.650 | 0.954 | 0.0 |
| 0.0 | 0.015 | 0.027 | 0.039 | 0.0 |
| Second period | | | | |
| 0.2 | 0.139 | 0.050 | 0.046 | 0.0 |
| 0.7 | 0.485 | 0.173 | 0.161 | 0.0 |

It can be seen that:

1. Ratios between the two rows are equal in a single scan period (0.96 for the first scan period, 0.222 for the second).

2. Luminances between the two rows add up to the required values.

3. The peak luminances are equal or less than those during a standard scan.

The example above demonstrates the technique in a simple two line case. If the ratios in the luminance data are similar between the two lines then more benefit is obtained. Depending upon the type of calculations on image data, luminances can be reduced by an average of 30 percent or more, which can have a significant beneficial effect on pixel lifetime. Expanding the technique to consider more rows simultaneously can provide greater benefit.

An example of multiline addressing using SVD image matrix decomposition is given below.

We describe the driving system as matrix multiplication where I is, an image matrix (bit map file), D the displayed image (should be the same as I), R the row drive matrix and C the column drive matrix. The Columns of R describe the drive to the rows in 'line periods' and the Rows or R represent the rows driven. The one row at a time system is thus an identity matrix. For a 6×4 display chequer board display:

$$D(R, C) := R \cdot C$$

$$I := \begin{pmatrix} 1 & 0 & 1 & 0 & 1 & 0 \\ 0 & 1 & 0 & 1 & 0 & 1 \\ 1 & 0 & 1 & 0 & 1 & 0 \\ 0 & 1 & 0 & 1 & 0 & 1 \end{pmatrix}$$

$$C := 1$$

$$R := \begin{pmatrix} 1 & 0 & 0 & 0 \\ 0 & 1 & 0 & 0 \\ 0 & 0 & 1 & 0 \\ 0 & 0 & 0 & 1 \end{pmatrix}$$

$$R \cdot C = \begin{pmatrix} 1 & 0 & 1 & 0 & 1 & 0 \\ 0 & 1 & 0 & 1 & 0 & 1 \\ 1 & 0 & 1 & 0 & 1 & 0 \\ 0 & 1 & 0 & 1 & 0 & 1 \end{pmatrix}$$

which is the same as the image.

Now consider using a two frame drive method:

$$C := \begin{pmatrix} 1 & 0 & 1 & 0 & 1 & 0 \\ 0 & 1 & 0 & 1 & 0 & 1 \end{pmatrix}$$

$$R := \begin{pmatrix} 1 & 0 \\ 0 & 1 \\ 1 & 0 \\ 0 & 1 \end{pmatrix}$$

$$R \cdot C = \begin{pmatrix} 1 & 0 & 1 & 0 & 1 & 0 \\ 0 & 1 & 0 & 1 & 0 & 1 \\ 1 & 0 & 1 & 0 & 1 & 0 \\ 0 & 1 & 0 & 1 & 0 & 1 \end{pmatrix}$$

Again this is the same as the Image matrix.

The drive matrix can be calculated by using Singular Value Decomposition as follows (using MathCad nomenclature):

X:=svd($\mathbf{1}^T$) (gives U and V)

Y:=svds($\mathbf{1}^T$)(gives S as a vector of the diagonal elements)

Note Y has only two elements, ie two frames:

$$Y = \begin{pmatrix} 2.449 \\ 2.449 \\ 0 \\ 0 \end{pmatrix}$$

U:=submatrix (X,0,5,0,3) (ie top 6 rows)

V:=submatrix $(X,6,9,0,3)^T$ (ie lower 4 rows)

$X =$

| | 0 | 1 | 2 | 3 |
|---|---|---|---|---|
| 0 | 0.577 | 0 | 0.816 | 0 |
| 1 | 0 | 0.577 | 0 | 0.816 |
| 2 | 0.577 | 0 | -0.408 | $4.57 \cdot 10^{-14}$ |
| 3 | 0 | 0.577 | 0 | -0.408 |
| 4 | 0.577 | 0 | -0.408 | $-4.578 \cdot 10^{-14}$ |
| 5 | 0 | 0.577 | 0 | -0.408 |
| 6 | 0.707 | 0 | 0.707 | 0 |
| 7 | 0 | 0.707 | 0 | -0.707 |
| 8 | 0.707 | 0 | -0.707 | 0 |
| 9 | 0 | 0.707 | 0 | 0.707 |

W:=diag(Y) (ie. Format Y as a diagonal matrix)

$$W = \begin{pmatrix} 2.449 & 0 & 0 & 0 \\ 0 & 2.449 & 0 & 0 \\ 0 & 0 & 0 & 0 \\ 0 & 0 & 0 & 0 \end{pmatrix}$$

$$D := (U \cdot W \cdot V)^T$$

Checking D:

$$D = \begin{pmatrix} 1 & 0 & 1 & 0 & 1 & 0 \\ 0 & 1 & 0 & 1 & 0 & 1 \\ 1 & 0 & 1 & 0 & 1 & 0 \\ 0 & 1 & 0 & 1 & 0 & 1 \end{pmatrix}$$

$$R := (W \cdot V)^T$$

$$R = \begin{pmatrix} 1.732 & 0 & 0 & 0 \\ 0 & 1.732 & 0 & 0 \\ 1.732 & 0 & 0 & 0 \\ 0 & 1.732 & 0 & 0 \end{pmatrix}$$

(Note the empty last 2 columns)

R:=submatrix(R,0,3,0,1) (select the non-empty columns)

$$R = \begin{pmatrix} 1.732 & 0 \\ 0 & 1.732 \\ 1.732 & 0 \\ 0 & 1.732 \end{pmatrix}$$

$$C := U^T$$

$$C = \begin{pmatrix} 0.577 & 0 & 0.577 & 0 & 0.577 & 0 \\ 0 & 0.577 & 0 & 0.577 & 0 & 0.577 \\ 0.816 & 0 & -0.408 & 0 & -0.408 & 0 \\ 0 & 0.816 & 4.57\times10^{-14} & -0.408 & -4.578\times10^{-14} & -0.408 \end{pmatrix}$$

(As we reduced R so C is reduced to top rows only)

$$C := \text{submatrix}(C, 0, 1, 0, 5)$$

$$C = \begin{pmatrix} 0.577 & 0 & 0.577 & 0 & 0.577 & 0 \\ 0 & 0.577 & 0 & 0.577 & 0 & 0.577 \end{pmatrix}$$

$$R \cdot C = \begin{pmatrix} 1 & 0 & 1 & 0 & 1 & 0 \\ 0 & 1 & 0 & 1 & 0 & 1 \\ 1 & 0 & 1 & 0 & 1 & 0 \\ 0 & 1 & 0 & 1 & 0 & 1 \end{pmatrix}$$

Which is the same as the desired image.

Now consider a more general case, an image of the letter "A":

$$I := \begin{pmatrix} 0 & 0 & 1 & 1 & 0 & 0 \\ 0 & 1 & 0 & 0 & 1 & 0 \\ 1 & 1 & 1 & 1 & 1 & 1 \\ 1 & 0 & 0 & 0 & 0 & 1 \end{pmatrix}$$

$$X := svd(I^T)$$

$$Y := svds(I^T)$$

(Note Y has only two elements, ie three frames)

$$Y = \begin{pmatrix} 2.828 \\ 1.414 \\ 1.414 \\ 0 \end{pmatrix}$$

$$U := \text{submatrix}(X, 0, 5, 0, 3)$$

$$V := \text{submatrix}(X, 6, 9, 0, 3)^T$$

$$W := diag(Y)$$

$$D := (U \cdot W \cdot V)^T$$

$$D = \begin{pmatrix} 0 & 0 & 1 & 1 & 0 & 0 \\ 0 & 1 & 0 & 0 & 1 & 0 \\ 1 & 1 & 1 & 1 & 1 & 1 \\ 1 & 0 & 0 & 0 & 0 & 1 \end{pmatrix}$$

(Checking D)

$$R := (W \cdot V)^T$$

$$R = \begin{pmatrix} -0.816 & 1.155 & 0 & 0 \\ -0.816 & -0.577 & 1 & 0 \\ -2.449 & 0 & 0 & 0 \\ -0.816 & -0.577 & -1 & 0 \end{pmatrix}$$

(Note empty last columns).

$$R := \text{submatrix}(R, 0, 3, 0, 2)$$

$$V = \begin{pmatrix} -0.289 & -0.289 & -0.866 & -0.289 \\ 0.816 & -0.408 & 0 & -0.408 \\ 0 & 0.707 & 0 & -0.707 \\ 0.5 & 0.5 & -0.5 & 0.5 \end{pmatrix}$$

$$R = \begin{pmatrix} -0.816 & 1.155 & 0 \\ -0.816 & -0.577 & 1 \\ -2.449 & 0 & 0 \\ -0.816 & -0.577 & -1 \end{pmatrix}$$

$$C := U^T$$

$$W = \begin{pmatrix} 2.828 & 0 & 0 & 0 \\ 0 & 1.414 & 0 & 0 \\ 0 & 0 & 1.414 & 0 \\ 0 & 0 & 0 & 0 \end{pmatrix}$$

$$C = \begin{pmatrix} -0.408 & -0.408 & -0.408 & -0.408 & -0.408 & -0.408 \\ -0.289 & -0.289 & 0.577 & 0.577 & -0.289 & -0.289 \\ -0.5 & 0.5 & 0 & 0 & 0.5 & -0.5 \\ -0.671 & -0.224 & 0 & 0 & 0.224 & -0.671 \end{pmatrix}$$

(As we reduced R so C is reduced to top rows only).

$$C := \text{submatrix}(C, 0, 2, 0, 5)$$

$$C = \begin{pmatrix} -0.408 & -0.408 & -0.408 & -0.408 & -0.408 & -0.408 \\ -0.289 & -0.289 & 0.577 & 0.577 & -0.289 & -0.289 \\ -0.5 & 0.5 & 0 & 0 & 0.5 & -0.5 \end{pmatrix}$$

$$R \cdot C = \begin{pmatrix} 0 & 0 & 1 & 1 & 0 & 0 \\ 0 & 1 & 0 & 0 & 1 & 0 \\ 1 & 1 & 1 & 1 & 1 & 1 \\ 1 & 0 & 0 & 0 & 0 & 1 \end{pmatrix}$$

Which is the same as the desired image.

In this case there are negative numbers in R and C which is undesirable for driving a passive matrix OLED display. By inspection it can be seen that a positive factorisation is possible:

$$R := \begin{pmatrix} 1 & 0 & 0 \\ 0 & 1 & 0 \\ 1 & 1 & 1 \\ 0 & 0 & 1 \end{pmatrix}$$

-continued $$C := \begin{pmatrix} 0 & 0 & 1 & 1 & 0 & 0 \\ 0 & 1 & 0 & 0 & 1 & 0 \\ 1 & 0 & 0 & 0 & 0 & 1 \end{pmatrix}$$

$$R \cdot C = \begin{pmatrix} 0 & 0 & 1 & 1 & 0 & 0 \\ 0 & 1 & 0 & 0 & 1 & 0 \\ 1 & 1 & 1 & 1 & 1 & 1 \\ 1 & 0 & 0 & 0 & 0 & 1 \end{pmatrix}$$

Non-negative matrix factorization (NMF) provides a method for achieving this in the general case. In non-negative matrix factorization the image matrix I is factorised as:

$$I = W \cdot H \qquad \text{(Equation 3)}$$

Some examples of NMF techniques are described in the following references, all hereby incorporated by reference:

D. D. Lee, H. S. Seung. Algorithms for non-negative matrix factorization; P. Paatero, U. Tapper. Least squares formulation of robust non-negative factor analysis. Chemometr. Intell. Lab. 37 (1997), 23-35; P. Paatero. A weighted non-negative least squares algorithm for three-way 'PARAFAC' factor analysis. Chemometr. Intell. Lab. 38 (1997), 223-242; P. Paatero, P. K. Hopke, etc. Understanding and controlling rotations in factor analytic models. Chemometr. Intell. Lab. 60 (2002), 253-264; J. W. Demmel. Applied numerical linear algebra. Society for Industrial and Applied Mathematics, Philadelphia. 1997; S. Juntto, P. Paatero. Analysis of daily precipitation data by positive matrix factorization. Environmetrics, 5 (1994), 127-144; P. Paatero, U. Tapper. Positive matrix factorization: a non-negative factor model with optimal utilization of error estimates of data values. Environmetrics, 5 (1994), 111-126; C. L. Lawson, R. J. Hanson. Solving least squares problems. Prentice-Hall, Englewood Cliffs, N.J., 1974; Algorithms for Non-negative Matrix Factorization, Daniel D. Lee, H. Sebastian Seung, pages 556-562, Advances in Neural Information Processing Systems 13, Papers from Neural Information Processing Systems (NIPS) 2000, Denver, Colo., USA. MIT Press 2001.

Figure 9A:
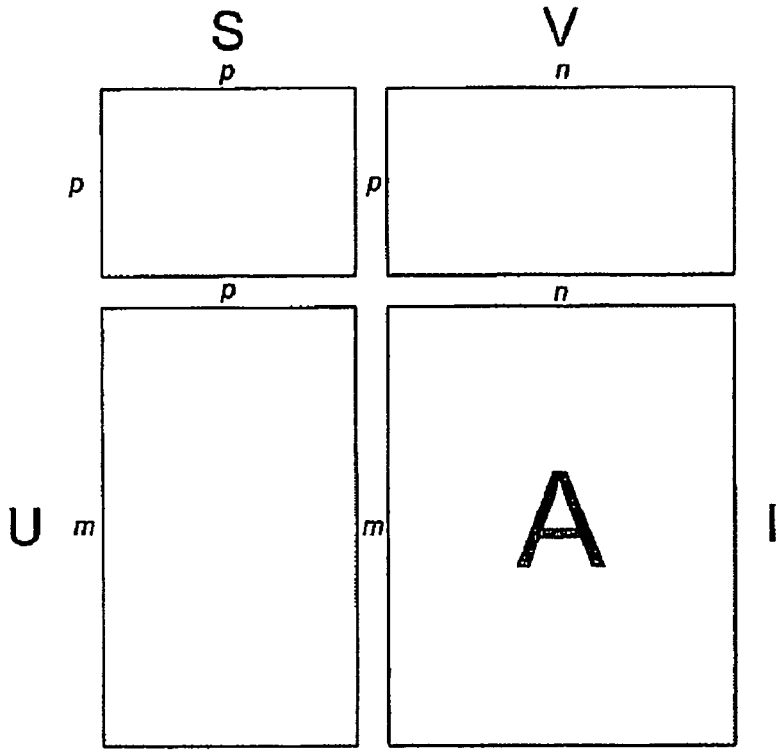
FIGS. 9*a* and 9*b* show, respectively, SVD and NMF factorisation of an image matrix.
Figure 9B:
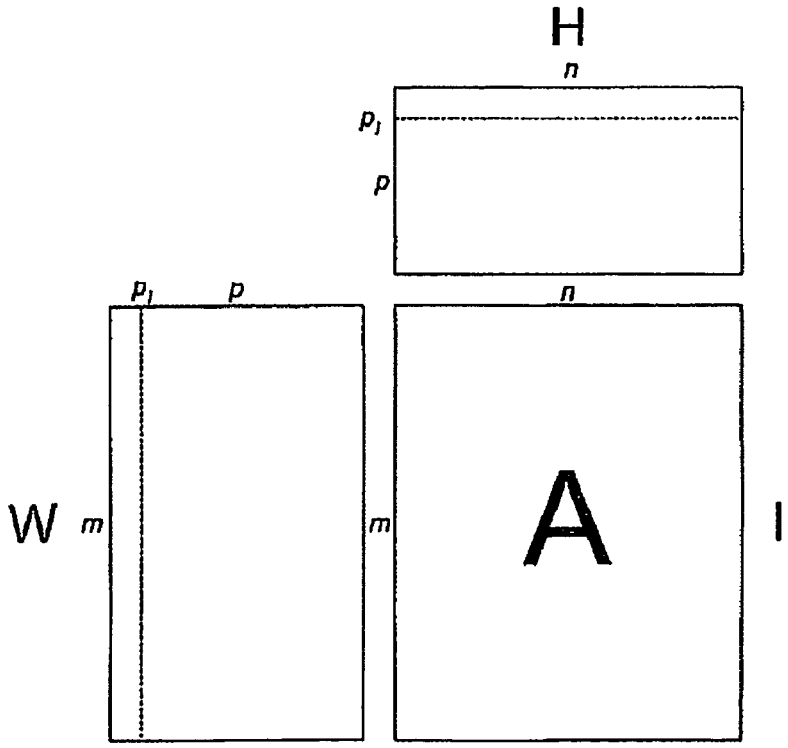

The NMF factorisation procedure is diagrammatically illustrated in FIG. 9*b*.

Once the basic above-described scheme has been implemented other techniques can be used for additional benefit. For example duplicate rows of pixels, which are not uncommon in Windows™ type applications, can be written simultaneously to reduce the number of line periods, hence shortening the frame period and reducing the peak brightness required for the same integrated brightness. Once an SVD decomposition has been obtained the lower rows with only small (drive) values can be neglected as they are of decreasing significance to the quality of the final image. As described above the multi-line addressing technique described above is applied within a single displayed frame but it will be recognised that a luminescence profile of one or more rows may be built up over the time dimension additionally or alternatively to a spatial dimension. This may be facilitated by moving picture compression techniques in which between-frame time interpolation is employed.

Embodiments of the above MLA techniques are particularly useful in colour OLED displays, in which case the techniques are preferably employed for groups of red (R), green (G), and blue (B) sub-pixels as well as, optionally, between pixel rows. This is because images tend to contain blocks of similar colour, and because a correlation between R, G and B sub-pixel drives is often higher than between separate pixels. Thus in embodiments of the scheme rows for multi-line addressing are grouped into R, G, and B rows with three rows defining a complete pixel and an image being built up by selecting combinations of the R, G and B rows simultaneously. For example if a significant area of the image to be displayed is white the image can be built up by first selecting groups of R, G and B rows together while applying appropriate signals to the column drivers.

Application of the MLA scheme to a colour display has a further advantage. In a conventional colour OLED display a row of pixels has the pattern "RGBRGB . . . " so that when the row is enabled separate column drivers can simultaneously drive the R, G and B sub-pixels to provide a full colour illuminated pixel. However the three rows may have the configuration "RRRR . . . " "GGGG . . . ", "BBBB . . . ", a single column addressing R, G and B sub-pixels. This configuration simplifies the application of an OLED display since a row of, say, red pixels may be (inkjet) printed in a single long trough (separated from adjacent troughs by the cathode separator) rather than separate "wells" being required to define regions for the three different coloured materials in each row. This enables the elimination of a fabrication step and also increases the pixel aperture ratio (that is the percentage of display area occupied by active pixel). Thus in a further aspect the invention provides a display of this type.

Figure 4A:
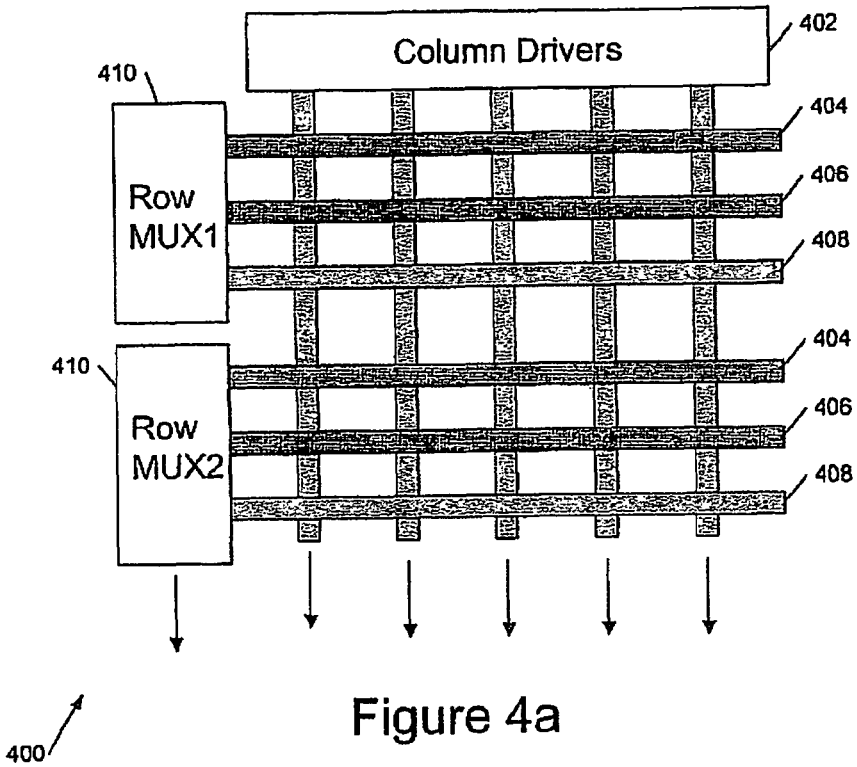
FIGS. 4*a* to 4*c*, show respectively, block diagrams of first and second examples of display driver hardware for implementing an MLA addressing scheme for a colour OLED display, and a timing diagram for such a scheme.

FIG. 4*a* shows a block diagram of an example display/driver hardware configuration 400 for such a scheme. As can be seen a single column driver 402 addresses rows of red 404, green 406 and blue 408 pixels. Permutations of red, green and blue rows are addressed using row selectors/multiplexers 410 or, alternatively, by means of a current sink controlling each row as described further later. It can be seen from FIG. 4*a* that this configuration allows red, green and blue sub-pixels to be printed in linear troughs (rather than wells) each sharing a common electrode. This reduces substrate patterning and printing complexity and increases aperture ratio (and hence indirectly lifetime through the reduced drive necessary). With the physical device layout of FIG. 4*a* a number or different MLA drive schemes may be implemented.

In a first example drive scheme an image is built up by addressing groups of rows in sequence as shown below:

1. White component: R, G, and B are selected and driven together
2. Red+Blue driven together
3. Blue+Green driven together
4. Red+Green driven together
5. Red only
6. Blue only
7. Green only Only the necessary colour steps are carried out to build up the image using the minimum number of colour combinations. The combinations may be optimised to increase lifetime and/or reduce power consumption, depending on the requirement of the application.

In an alternative colour MLA scheme, the driving of the RGB rows is split into three line scan periods, with each line period driving one primary. The primaries are combinations of R G and B chosen to form a colour gamut which encloses all the desired colours along a line or row of the display:

In one method the primaries are R+aG=aB, G+bR+bB, B+cR+cG where 0>=a,b,c>=1 and a, b and c are chosen to be the largest possible values (a+b+c=maximum) while still enclosing all desired colours within their colour gamut.

In another method a, b and c are chosen in a scheme to best improve the overall performance of the display. For example, if blue lifetime is a limiting factor, a and b may be maximised at the expense of c; if red power consumption is a problem, b and c can be maximised. This is because the total emitted brightness should equal a fixed value. Consider an example where b=c=0. In this case the red brightness must be fully achieved in the first scan period. However if b,c>0 then the red brightness is built up more gradually over multiple scan periods, thus reducing the peak brightness and increasing the red subpixel lifetime and efficiency.

In another variation the length of the individual scan periods can be adjusted to optimise lifetime or power consumptions (for example to provide increased scan time).

In a further variation the primaries may be chosen arbitrarily, but to define the minimum possible colour gamut which still encloses all colours on a line of the display. For example in an extreme case, if there were only shades of greens on a reproducible colour gamut.

Figure 4B:
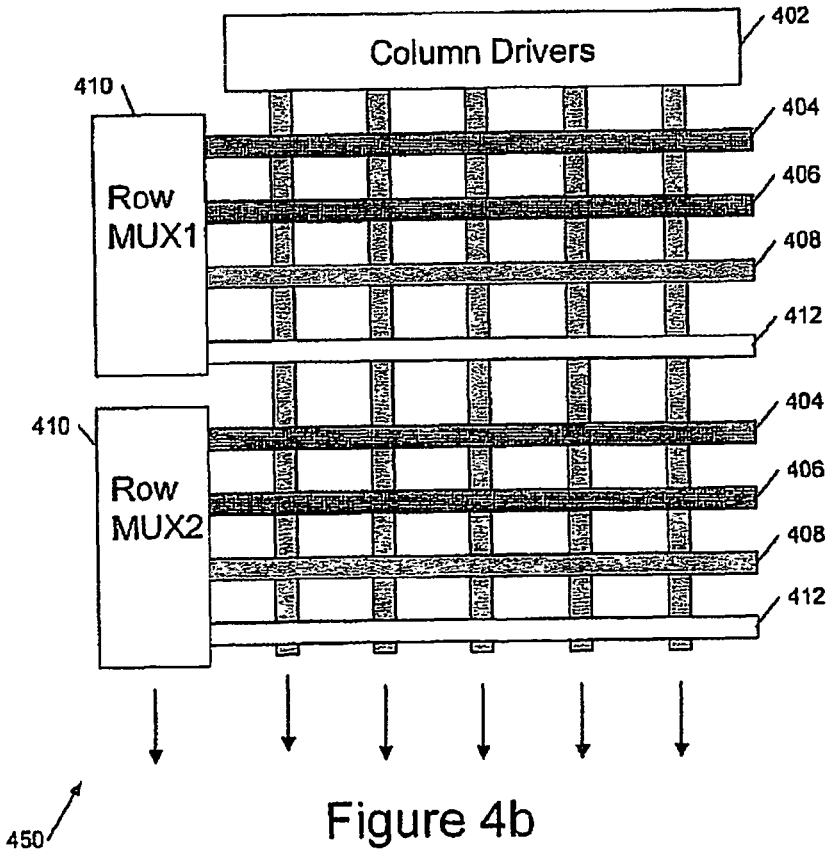

FIG. 4*b* shows a second example of display driver hardware 450 in which like elements to those in FIG. 4*a* are shown by like reference minerals. In FIG. 4*b* the display includes additional rows of white (W) pixels 412 which are also used to build up a colour image when driven in combination with three primaries.

The inclusion of white sub-pixels broadly speaking reduces the demands on the blue pixels thus increasing display lifetime; alternatively, depending on the drive scheme, power consumption for display of given colour may be reduced. Colours other than white, for example magenta, cyan, and/or yellow emitting sub-pixels may be included, for example to increase the colour gamut. The different coloured sub-pixels need not have the same area.

As illustrated in FIG. 4*b* each row comprises sub-pixels of a single colour, as described with reference to FIG. 4*a*, but it will be appreciated that a conventional pixel layout may also be employed with successive R, G, B and W pixels along each row. In this case the columns will be driven by four separate column drivers, one for each of the four colours.

It will be appreciated that the above described multi-line addressing schemes may be employed in connection with the display/driver arrangement of FIG. 4*b*, with combinations of R, G, B and W rows being addressed in different permutations and/or with different drive ratios, either using row multiplexers (as illustrated) or a current sink for each line. As described above an image is built up by successively driving different combinations of rows.

As outlined above and described in more detail below, some preferred drive techniques employ a variable current drive to the OLED display pixels. However a simpler drive scheme, which has no need for row current mirrors, may be implemented using one or more row selectors/multiplexers to select rows of the display singularly and in combination in accordance with the first example colour display drive scheme given above.

Figure 4C:
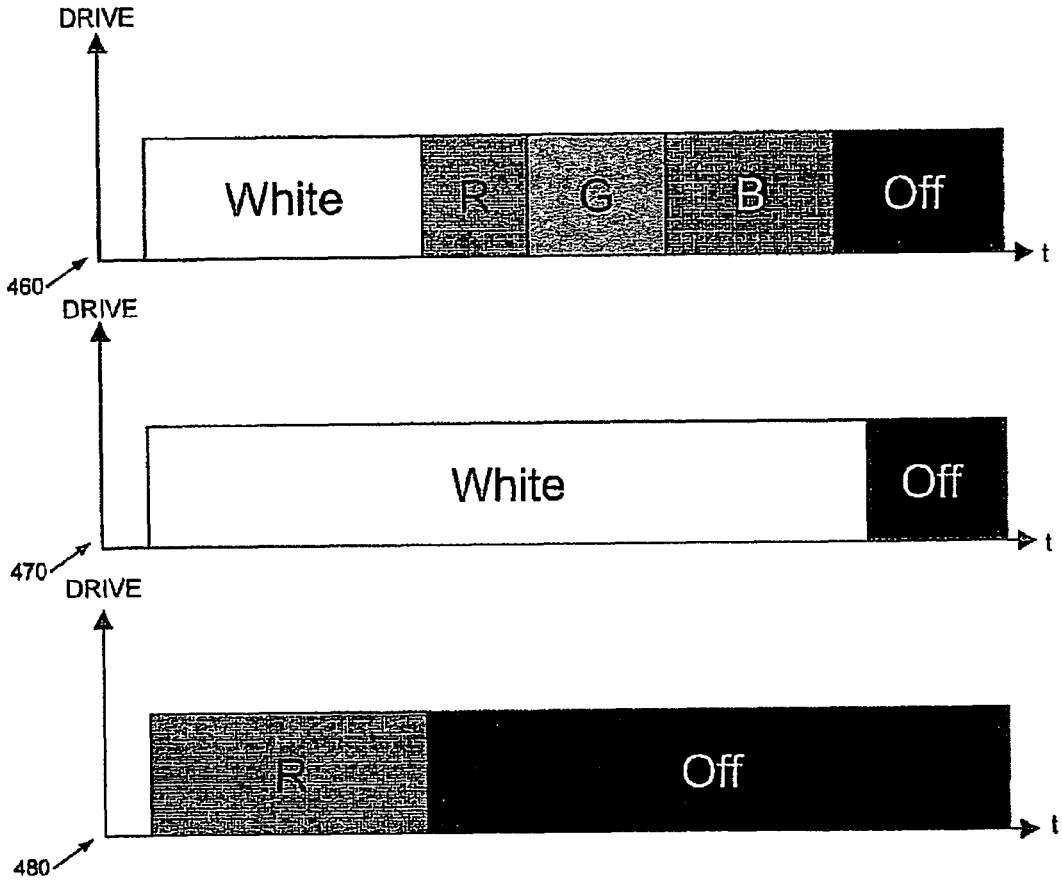

FIG. 4*c* illustrates the timing of row selection in such a scheme. In a first period 460 white, red, green and blue rows are selected and driven together; in a second period 470 white only is driven, and in a third period 480 red only is driven, all according to a pulse-width modulation drive timing.

Figure 5A:
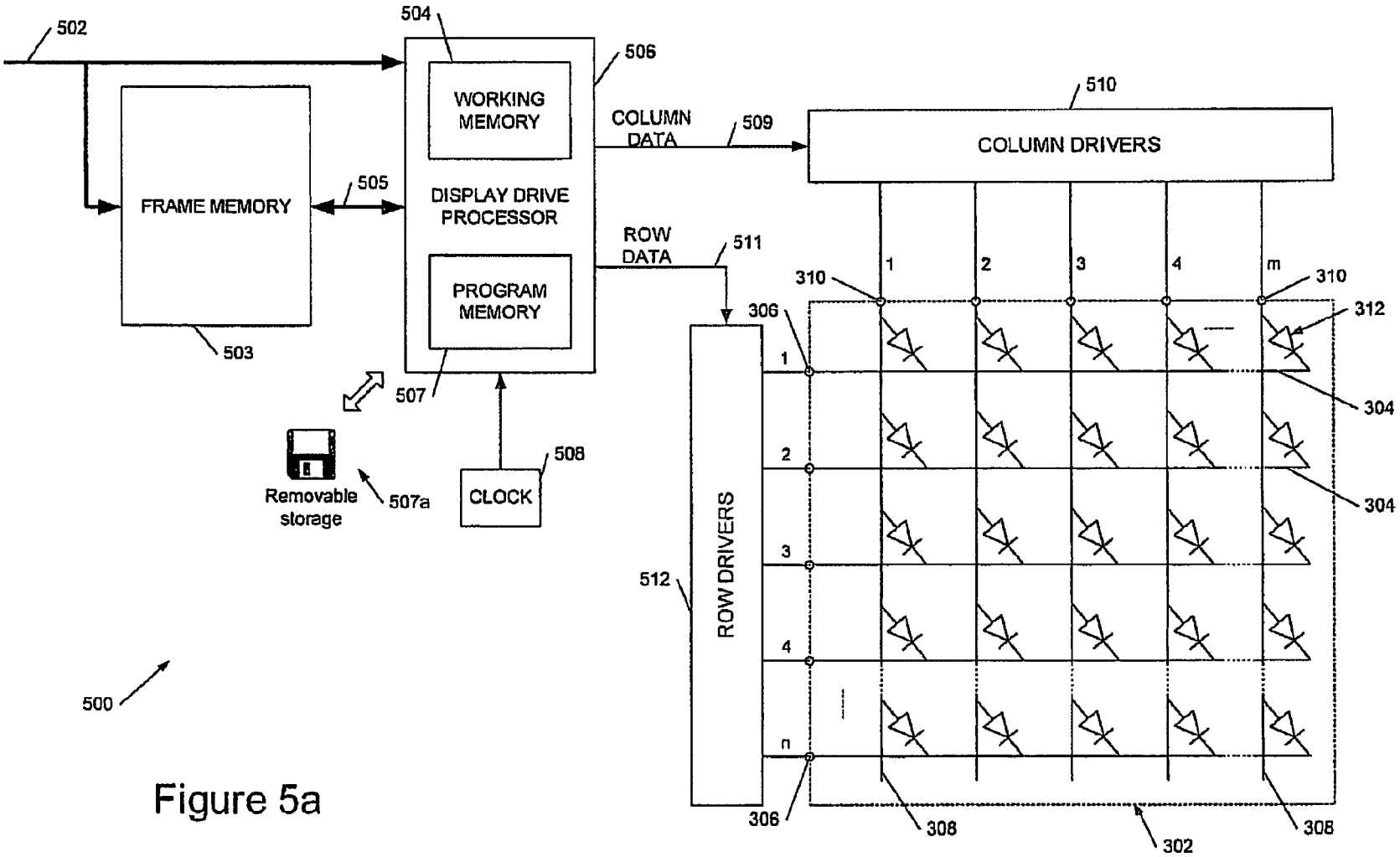
FIGS. 5*a* to 5*g* show, respectively, a display driver embodying an aspect of the present invention; column and row drivers, example digital-to-analogue current converters for the display driver of FIG. 5*a*, a programmable current mirror embodying an aspect of the present invention, a second programmable current mirror embodying an aspect of the present invention, and block diagrams of current mirrors according to the prior art.

Referring next to FIG. 5*a*, this shows a schematic diagram of an embodiment of a passive matrix OLED driver 500 which implements an MLA addressing scheme as described above.

Figure 3:
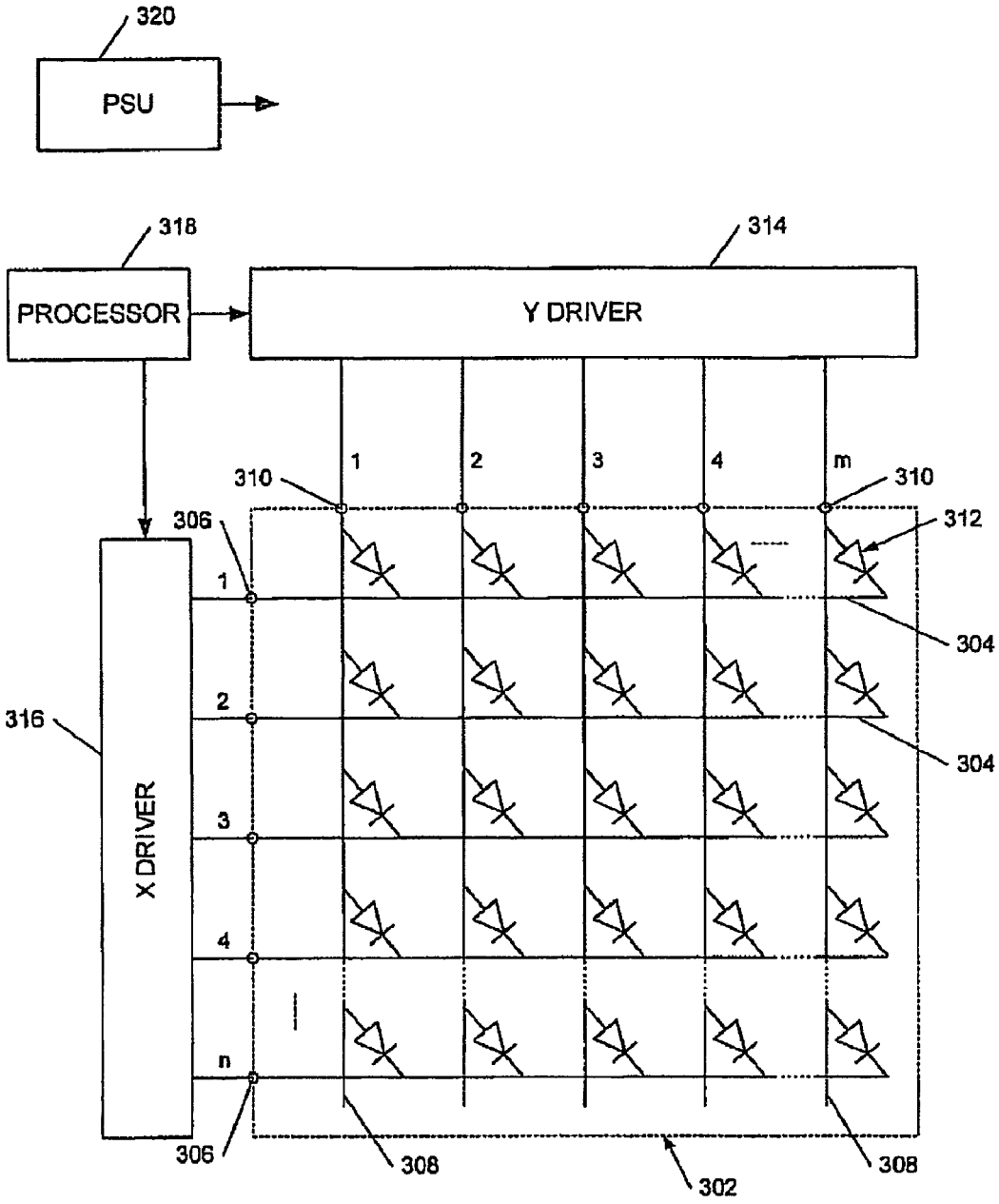
Figure 3 (PRIOR ART)
FIG. 3 shows a block diagram of a known passive matrix OLED display driver.
Figure 5B:
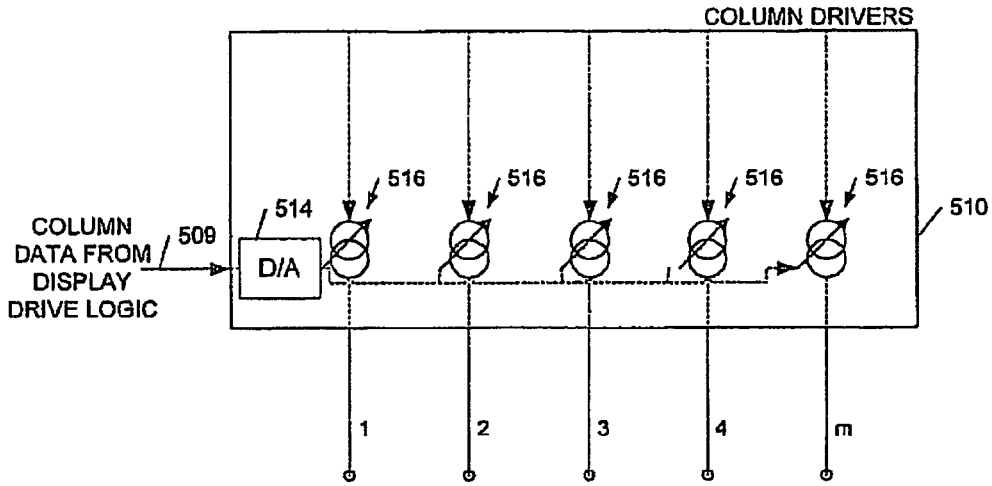
Figure 5B:
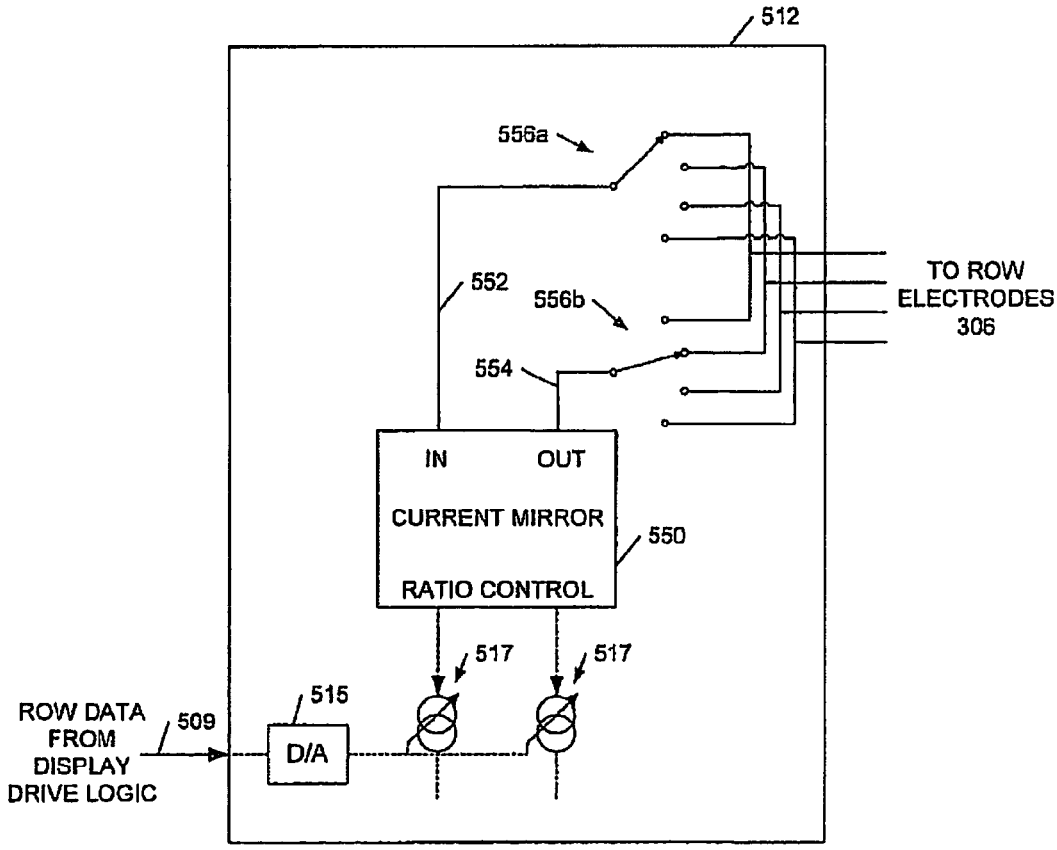

In FIG. 5*a* a passive matrix OLED display similar to that described with reference to FIG. 3 has row electrodes 306 driven by row driver circuits 512 and column electrodes 310 driven by column drives 510. Details of these row and column drivers are shown in FIG. 5*b*. Column drivers 510 have a column data input 509 for setting the current drive to one or more of the column electrodes; similarly row drivers 512 have a row data input 511 for setting the current drive ratio to two or more of the rows. Preferably inputs 509 and 511 are digital inputs for ease of interfacing; preferably column data input 509 sets the current drives for all the m columns of display 302.

Data for display is provided on a data and control bus 502, which may be either serial or parallel. Bus 502 provides an input to a frame store memory 503 which stores luminance data for each pixel of the display or, in a colour display, luminance information for each sub-pixel (which may be encoded as separate RGB colour signals or as luminance and chrominance signals or in some other way). The data stored in frame memory 503 determines a desired apparent brightness for each pixel (or sub-pixel) for the display, and this information may be read out by means of a second, read bus 505 by a display drive processor 506 (in embodiments bus 505 may be omitted and bus 502 used instead).

Display drive processor 506 may be implemented entirely in hardware, or in software using, say, a digital signal processing core, or in a combination of the two, for example, employing dedicated hardware to accelerate matrix operations. Generally, however, display drive processor 506 will be at least partially implemented by means of stored program code or micro code stored in a program memory 507, operating under control of a clock 508 and in conjunction with working memory 504. Code in program memory 507 may be provided on a data carrier or removable storage 507*a*.

The code in program memory 507 is configured to implement one or more of the above described multi-line addressing methods using conventional programming techniques. In some embodiments these methods may be implemented using a standard digital signal processor and code running in any conventional programming language. In such an instance a conventional library of DSP routines may be employed, for example, to implement singular value decomposition, or dedicated code may be written for this purpose, or other embodiments not employing SVD may be implemented such as the techniques described above with respect to driving colour displays.

Figure 5C:
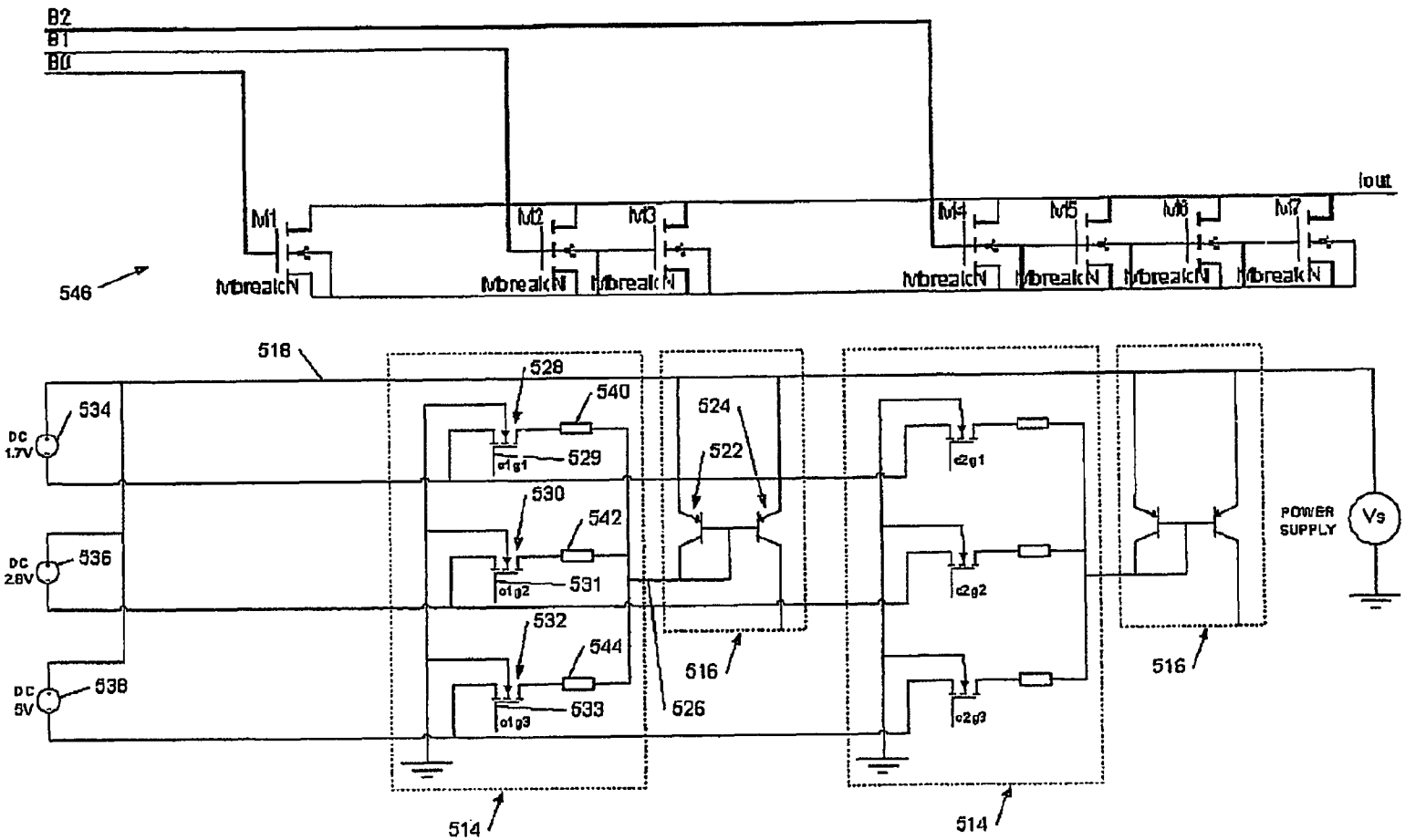

Referring now to FIG. 5*b*, this shows details of the column 510 and row 512 drivers of FIG. 5*a*. The column driver circuitry 510 includes a plurality of controllable reference current sources 516, one for each column line, each under control of respective digital-to-analogue converter 514. Details of example implementations of these are shown in FIG. 5*c* where it can be seen that a controllable current source 516 comprises a pair of transistors 522, 524 connected to a power line 518 in a current mirror configuration. Since, in this example, the column drivers comprise current sources these are PNP bipolar transistors connected to a positive supply line; to provide a current sink NPN transistors connected to ground are employed; in other arrangements MOS transistors are used. The digital-to-analogue converters 514 each comprise a plurality (in this instance three) of FET switches 528, 530, 532 each connected to a respective power supply 534, 536, 538. The gate connections 529,531, 533 provide a digital input switching the respective power supply to a corresponding current set resistor 540, 542, 544, each resistor being connected to a current input 526 of a current mirror 516. The power supplies have voltages scaled in powers of two, that is each twice that of the next lowest power supply less a $V_{gs}$ drop so that a digital value on the FET gate connections is converted into a corresponding current on a line 526; alternatively the power supplies may have the same voltage and the resistors 540, 542, 544 may be scaled. FIG. 5*c* also shows an alternative D/A controlled current source/sink 546; in this arrangement where multiple transistors are shown a single appropriately-sized larger transistor may be employed instead.

The row drivers 512 also incorporate two (or more) digitally controllable current sources 515, 517, and these may be implemented using similar arrangements to those shown in FIG. 5*c*, employing current sink rather than current source mirrors. In this way controllable current sinks 517 may be programmed to sink currents in a desired ratio (or ratios) corresponding to a ratio (or ratios) of row drive levels. Controllable current sinks 517 are thus coupled to a ratio control current mirror 550 which has an input 552 for receiving a first, referenced current and one or more outputs 554 for receiving (sinking) one or more (negative) output currents, the ratio of an output current to the input current being determined by a ratio of control inputs defined by controllable current generators 517 in accordance with row data on line 509. Two row electrode multiplexers 556*a, b* are provided to allow selection of one row electrode to provide a reference current and another row electrode to provide an "output" current; optionally further selectors/multiplexers 556*b* and mirror outputs from 550 may be provided. As illustrated row driver 512 allows the selection of two rows for concurrent driving from a block of four row electrodes but in practice alternative selection arrangements may be employed—for example in one embodiment twelve rows (one reference and eleven mirrors) are selected from 64 row electrodes by twelve 64 way multiplexers; in another arrangement the 64 rows may be divided into several blocks each having an associated row driver capable of selecting a plurality of rows for simultaneous driving.

Figure 5D:
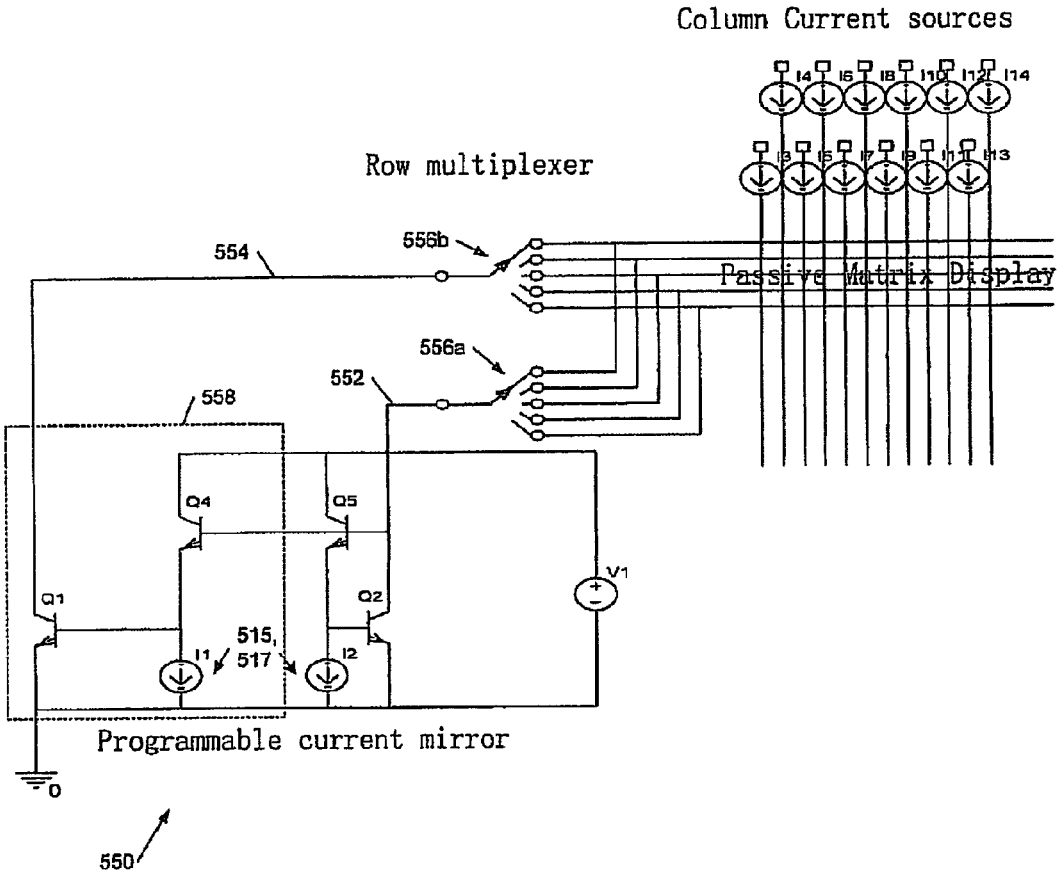

FIG. 5*d* shows details of an implementation of the programmable ratio control current mirror 550 of FIG. 5*b*. In this example implementation a bipolar current mirror with a so-called beta helper (Q5) is employed, but the skilled person will recognise that many other types of current mirror circuit may also be used. In the circuit of FIG. 5*d* V1 is a power supply of typically around 3V and I1 and I2 define the ratio of currents in the collectors of Q1 and Q2. The currents in the two lines 552, 554 are in the ratio I1 to I2 and thus a given total column current is divided between the two selected rows in this ratio. The skilled person will appreciate that this circuit can be extended to an arbitrary number of mirrored rows by providing a repeated implementation of the circuitry within dashed line 558.

Figure 5E:
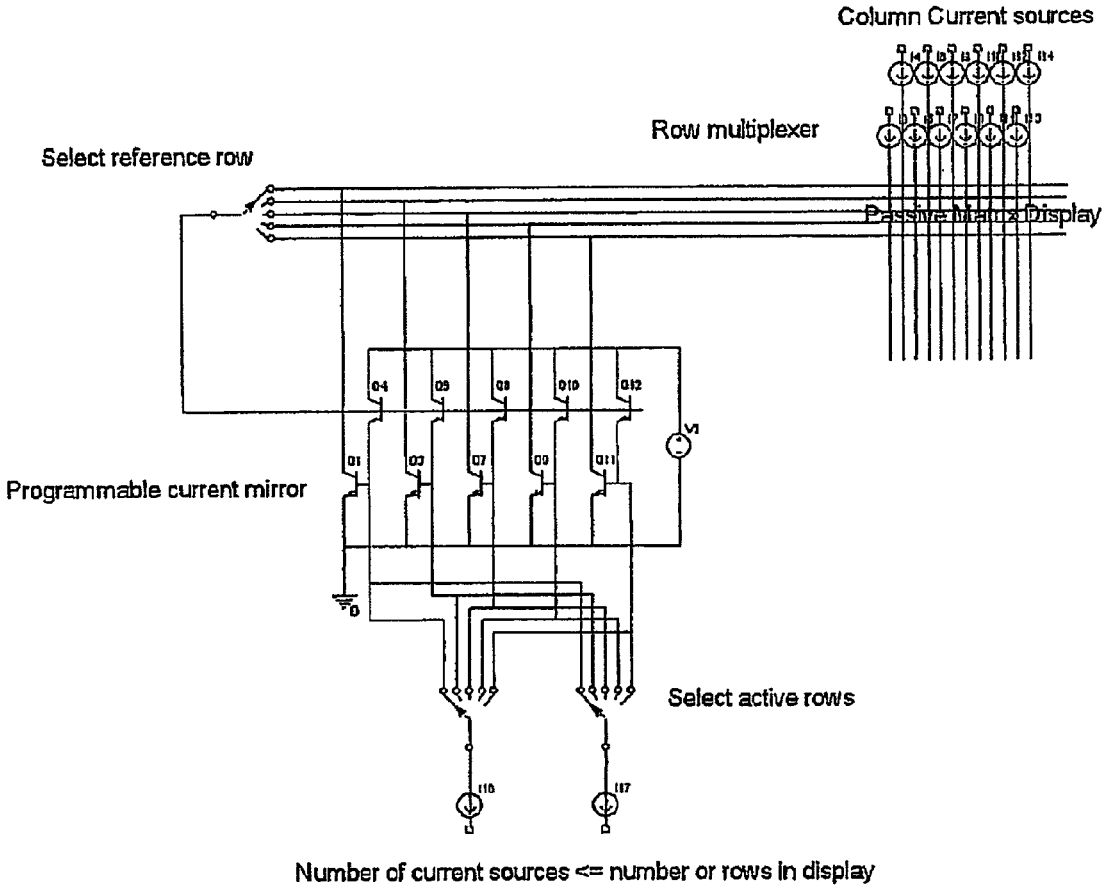

FIG. 5*e* illustrates an alternative embodiment of a programmable current mirror for the row driver 512 of FIG. 5*b*. In this alternative embodiment each row is provided with circuitry corresponding to that within dashed line 558 of FIG. 5*d*, that is with a current mirror output stage, and then one or more row selectors connects selected ones of these current mirror output stages to one or more respective programmable reference current supplies (source or sink). Another selector selects a row to be used as a reference input to the current mirror.

In embodiments of the above-described row drivers row selection need not be employed since a separate current mirror output may be provided for each row either of the complete display or for each row of a block of rows of the display. Where row selection is employed rows may be grouped in blocks—for example where a current mirror with three outputs is employed with selective connection to, say a group of 12 rows, sets of three successive rows may be selected in turn to provide three-line MLA for the 12 rows. Alternatively rows may be grouped using a priori knowledge relating to the line image to be displayed, for example where it is known that a particular sub-section of the image would benefit from MLA because of the nature of the displayed data (significant correlation between rows).

Figure 5F:
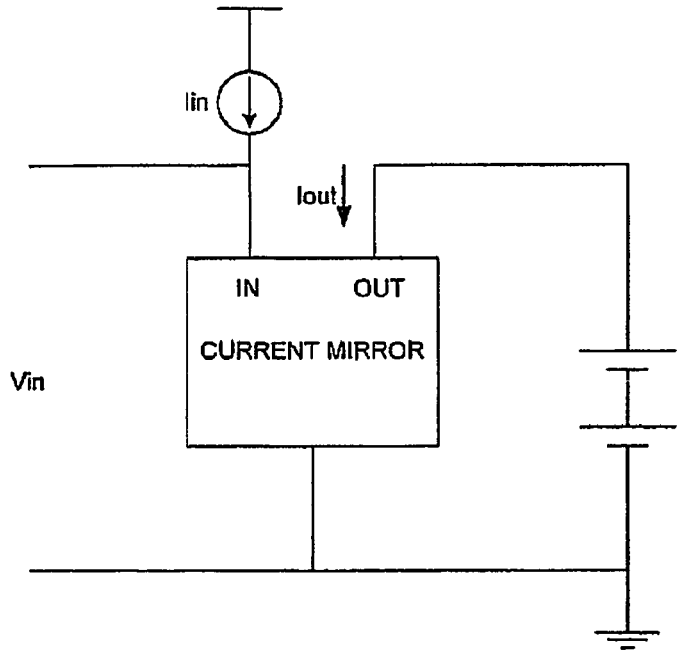
Figure 5f (PRIOR ART)
Figure 5G:
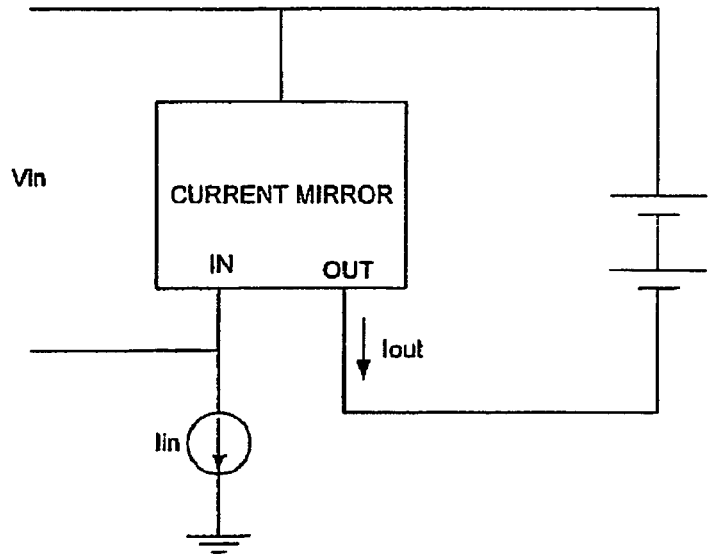
Figure 5g (PRIOR ART)

FIGS. 5*f* and 5*g* illustrate current mirror configurations according to the prior art with, respectively, a ground reference and a positive supply reference, showing the sense of the input and output currents. It can be seen that these currents are both in the same sense but maybe either positive or negative.

Figure 6:
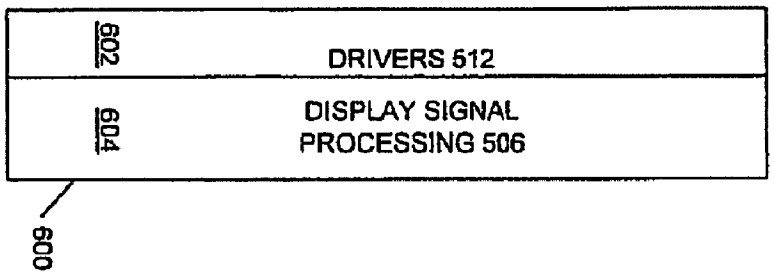
FIG. 6 shows, a layout of an integrated circuit die incorporating multi-line addressing display signal processing circuitry and driver circuitry.

FIG. 6 shows a layout of an integrated circuit die 600 combining the row drivers 512 and display drive processor 506 of FIG. 5*a* The die has the shape of an elongated rectangle, of example dimensions 20 mm×1 mm, with a first region 602 for a long line of driver circuitry comprising repeated implementations of substantially the same set of devices, and an adjacent region 604 used to implement the MLA display processing circuitry. Region 604 would otherwise be unused space since there is a minimum physical width to which a chip can be diced.

The above described MLA display drivers employ a variable current drive to control OLED luminance but the skilled person will recognise that other means of varying the drive to an OLED pixel, in particular PWM, may additionally or alternatively employed.

Figure 7:
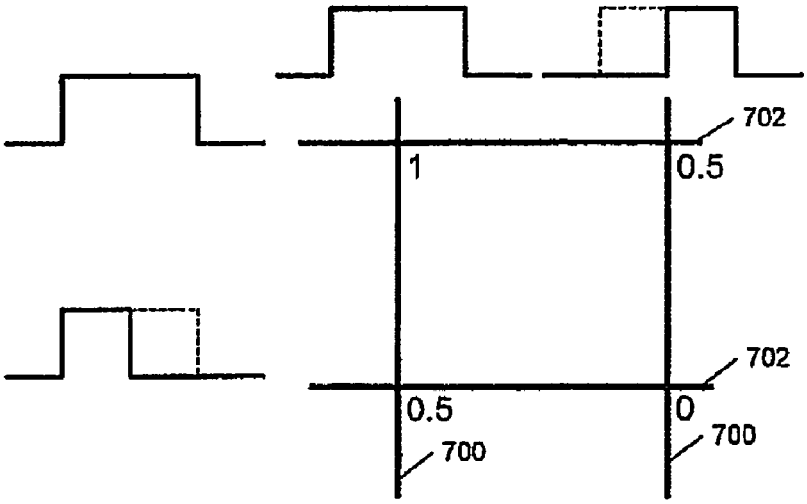
FIG. 7 shows a schematic illustration of a pulse width modulation MLA drive scheme.

FIG. 7 shows a schematic illustration of a pulse width modulation drive scheme for multi-line addressing. In FIG. 7 the column electrodes 700 are provided with a pulse width modulated drive at the same time as two or more row electrodes 702 to achieve the desired luminance patterns. In the example of FIG. 7 the zero value shown could be smoothly varied up to 0.5 by gradually shifting the second row pulse to a later time; in general a variable drive to a pixel may be applied by controlling a degree of overlap of row and column pulses.

Some preferred MLA methods employing matrix factorisation will now be described in more detail.

Figure 8A:
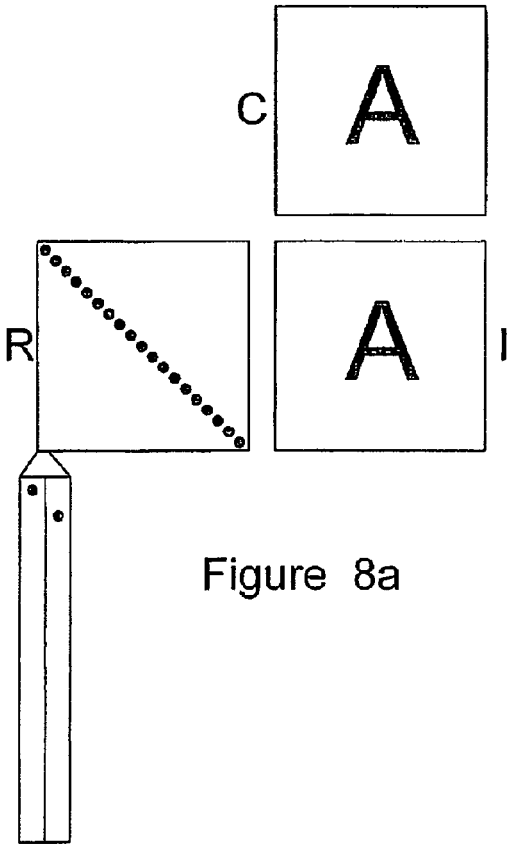
FIGS. 8*a* to 8*d* show row, column and image matrices for a conventional drive scheme and for a multiline addressing drive scheme respectively, and corresponding brightness curves for a typical pixel over a frame period.
Figure 8B:
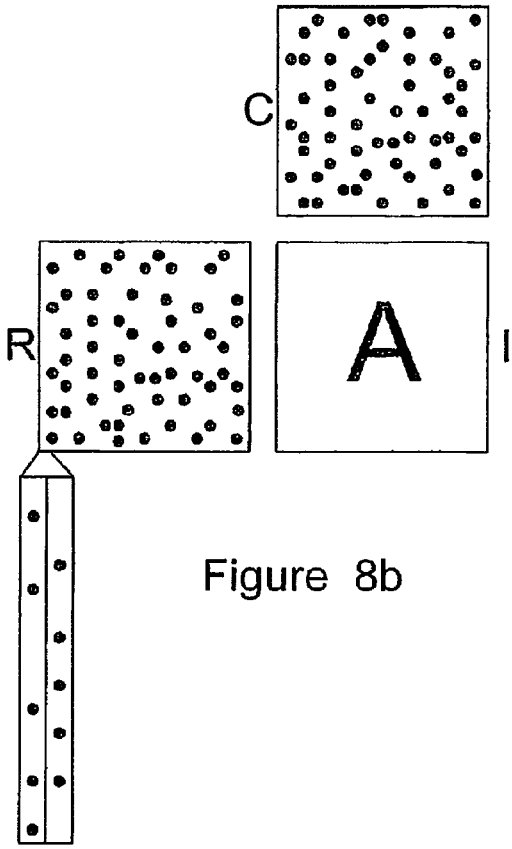
Figure 8C:
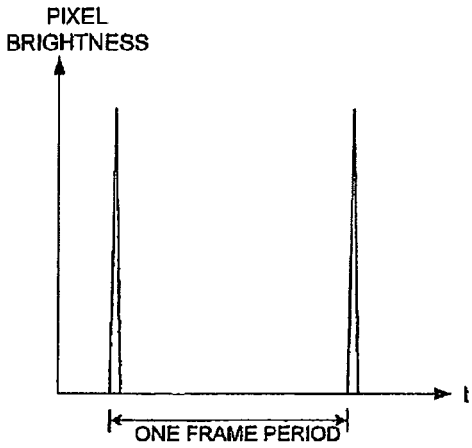
Figure 8D:
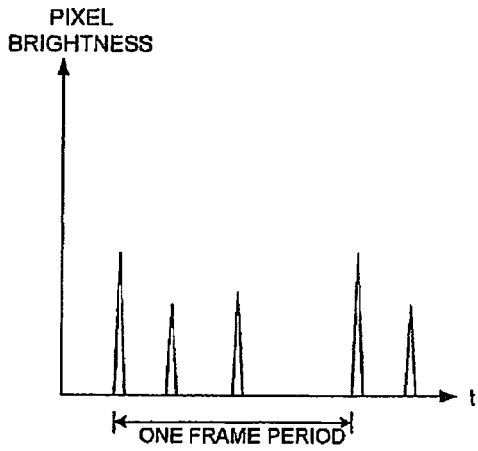

Referring to FIG. 8*a*, this shows row R, column C and image I matrices for a conventional drive scheme in which one row is driven at a time. FIG. 8*b* shows row, column and image matrices for a multiline addressing scheme. FIGS. 8*c* and 8*d* illustrate, for a typical pixel of the displayed image, the brightness of the pixel, or equivalently the drive to the pixel, over a frame period, showing the reduction in peak pixel drive which is achieved through multiline addressing.

FIG. 9*a* illustrates, diagrammatically, singular value composition (SVD) of an image matrix I according to Equation 2 below:

$$\underset{m\times n}{I} = \underset{m\times p}{U} \times \underset{p\times p}{S} \times \underset{p\times n}{V} \qquad \text{Equation 2}$$

The display can be driven by any combination of U, S and V, for example driving rows US and columns with V or driving rows with $U\sqrt{S}$ and column with $\sqrt{S}\cdot V$ other related techniques such as QR decomposition and LU decomposition can also be employed. Suitable numerical techniques are described in, for example, "Numerical Recipes in C: The Art of Scientific Computing", Cambridge University Press 1992; many libraries of program code modules also include suitable routines.

Figure 10:
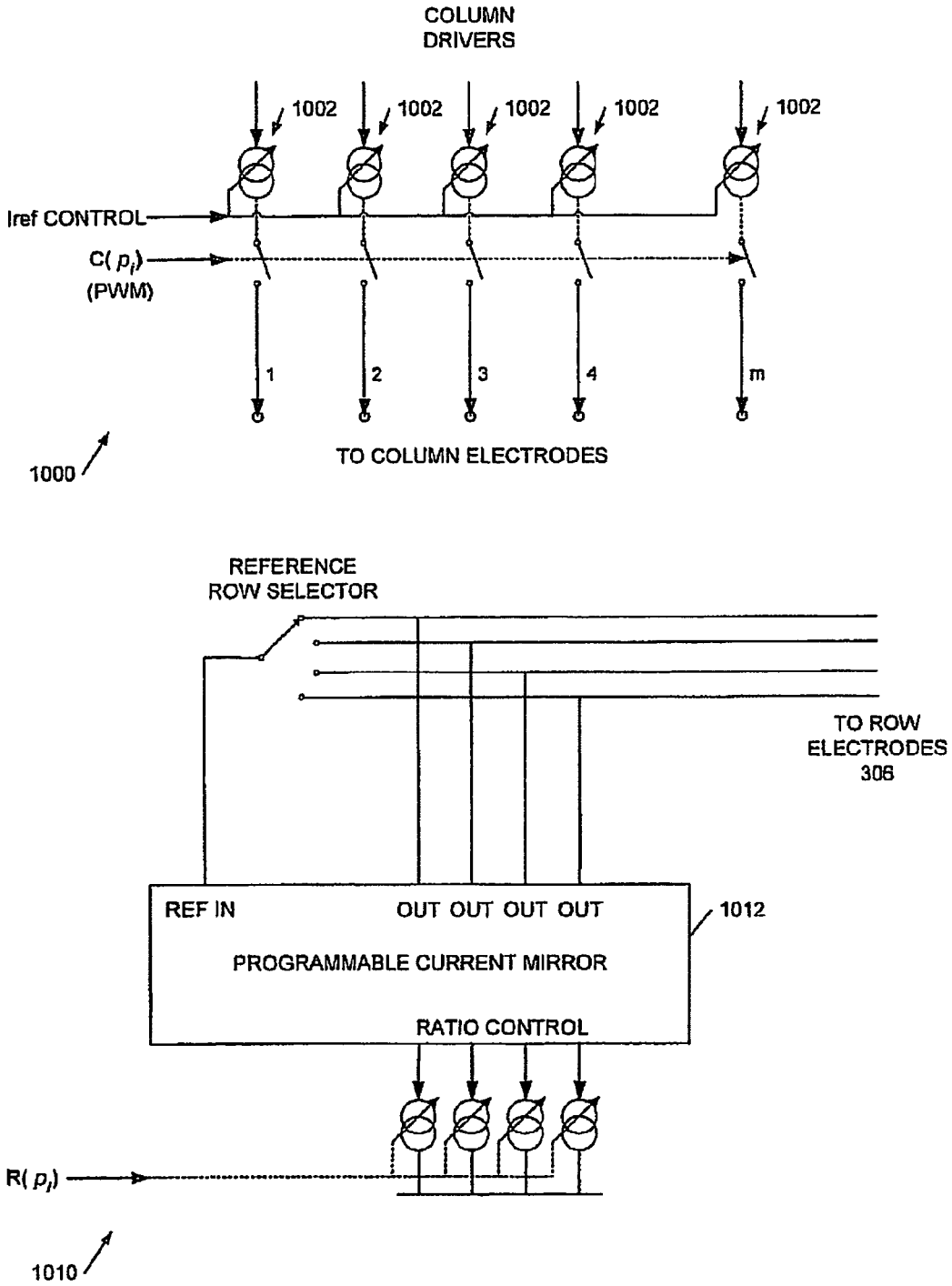
FIG. 10 shows example column and row drive arrangements for driving a display using the matrices of FIG. 9.

FIG. 10 illustrates row and column drivers similar to those described with reference to FIGS. 5*b* to 5*e* and suitable for driving a display with a factorised image matrix. The column drivers 1000 comprise a set of adjustable substantially constant current sources 1002 which are ganged together and provided with a variable reference current $I_{ref}$ for setting the current into each of the column electrodes. This reference current is pulse width modulated by a different value for each column derived from a row of a factor matrix such as row $p_i$ of matrix H of FIG. 9*b*. The row drive 1010 comprises a programmable current mirror 1012 similar to that shown in FIG. 5*e* but preferably with one output for each row of the display or for each row of a block of simultaneously driven rows. The row drive signals are derived from a column of a factor matrix such as column $p_i$ of matrix W of FIG. 9*b*.

Figure 11:
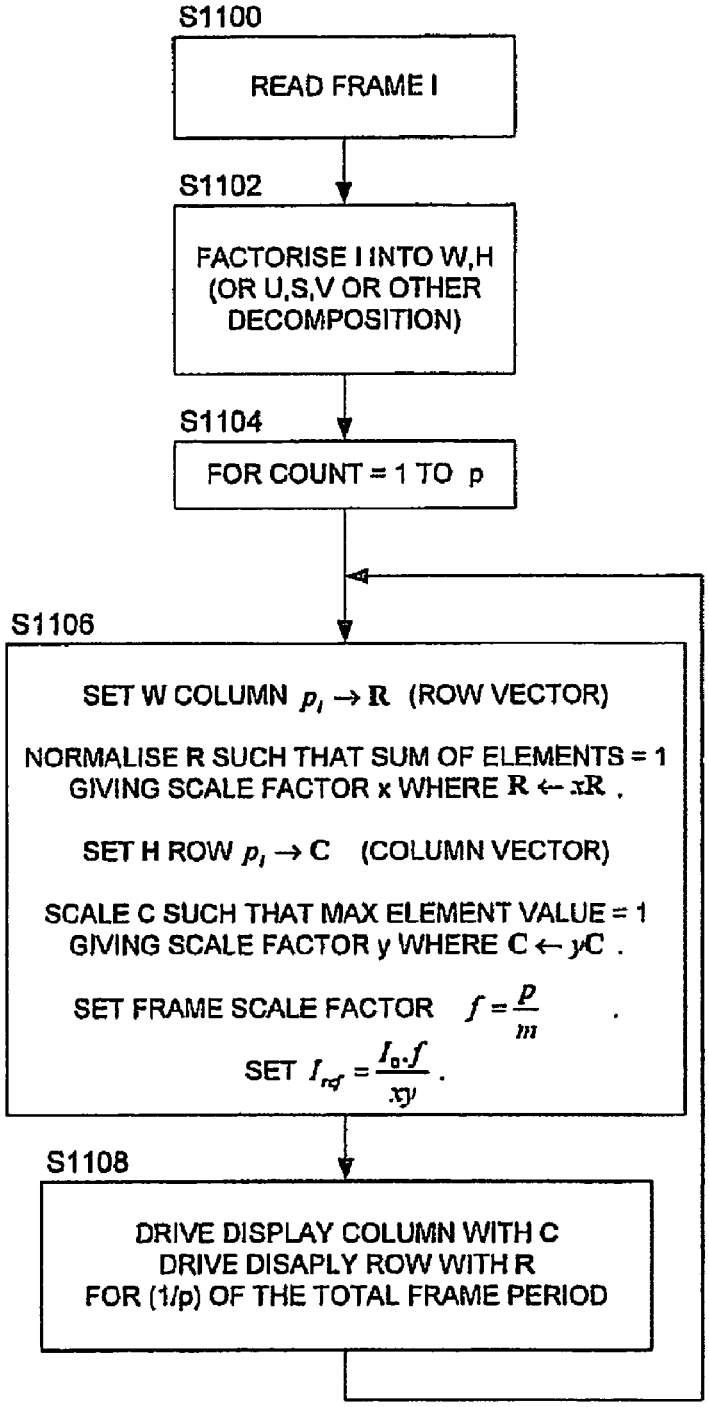
FIG. 11 shows a flow diagram for a method of driving a display using image matrix factorisation.

FIG. 11 shows a flow diagram of an example procedure for displaying an image using matrix factorisation such as NMF, and which may be implemented in program code stored in program memory 507 of display drive processor 506 of FIG. 5*a*.

In FIG. 11 the procedure first reads the frame image matrix I (step S1100), and then factorises this image matrix into factor matrices W and H using NMF, or into other factor matrices, for example U, S and V when employing SVD (step S1102). This factorisation may be computed during display of an earlier frame. The procedure then drives the display with p subframes at step 1104. Step 1106 shows the subframe drive procedure.

The subframe procedure sets W-column $p_i \rightarrow R$ to form a row vector R. This is automatically normalised to unity by the row driver arrangement of FIG. 10 and a scale factor x, $R \leftarrow xR$ is therefore derived by normalising R such that the sum of elements is unity. Similarly with H, row $p_i \rightarrow C$ to form a column vector C. This is scaled such that the maximum element value is 1, giving a scale factor y, $C \leftarrow yC$. The a frame scale factor $$f = \frac{p}{m}$$

is determined and the reference current set by $$I_{ref} = \frac{I_0 \cdot f}{xy}$$

where $I_0$ corresponds to the current required for full brightness in a conventionally scanned line-at-a-time system, the x and y factors compensating for scaling effects introduced by the driving arrangement (with other driving arrangements one or both of these may be omitted).

Following this, at step S1108, the display drivers shown in FIG. 10 drive the columns of the display with C and rows of the display with R for 1/p of the total frame period. This is repeated for each subframe and the subframe data for the next frame is then output.

Figure 12:
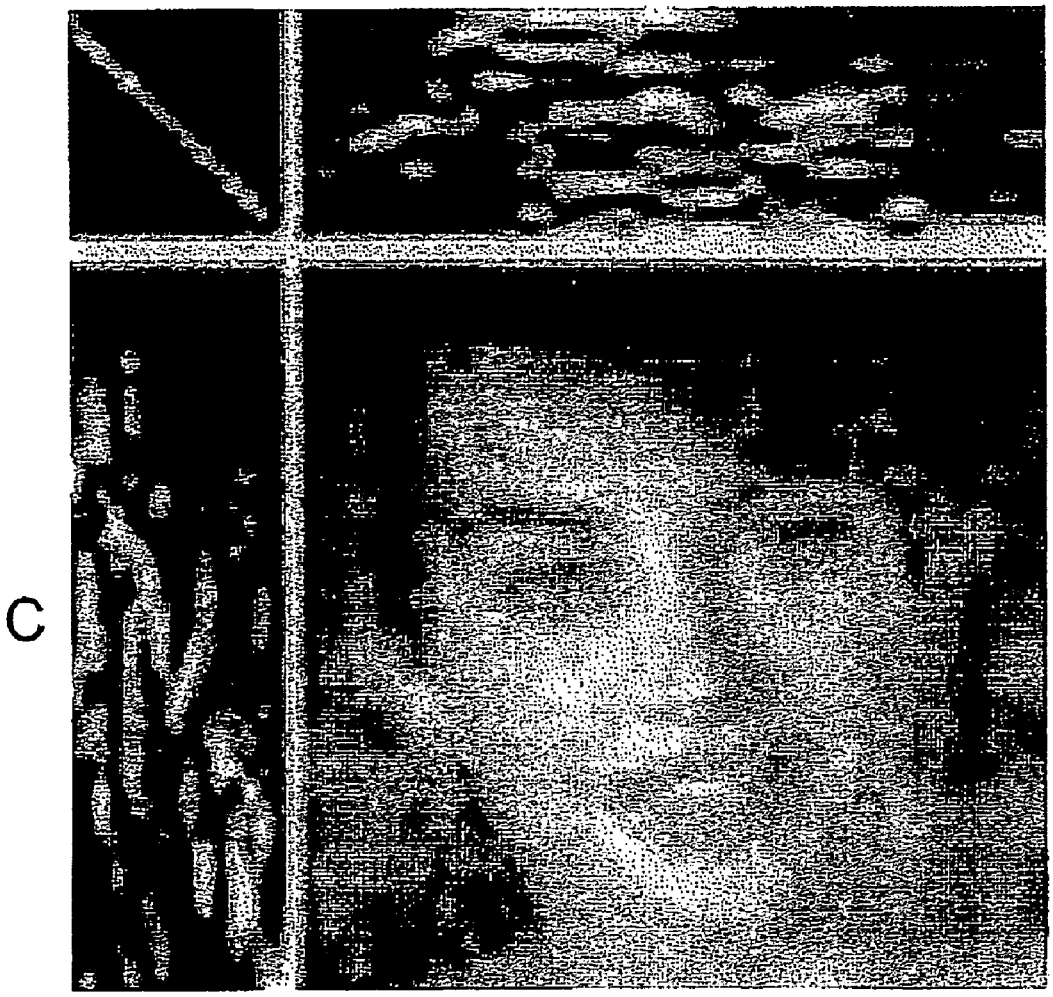
FIG. 12 shows an example of a displayed image obtained using image matrix factorisation.

FIG. 12 shows an example of an image constructed in accordance with an embodiment of the above described method; the format corresponds to that of FIG. 9*b*. The image in FIG. 12 is defined by a 50×50 image matrix which, in this example, is displayed using 15 subframes (p=15). The number of subframes can be determined in advance or varied according to the nature of the image displayed.

In some preferred embodiments of the above described systems and methods, in particular in full colour MLA passive matrix drive schemes, the schemes are configured to preserve a low grey level noise in the green channel at the expense of the red and blue channels. This technique is applicable, in particular, to MLA employing the above-mentioned NMF and SVD factorisation procedures.

One approach to MLA derives the multiline addressed sub-frames treating all three colour channels equally. However the eye perceives differences in the green much more than the red and both of these more than the blue, so overall perceived image quality may be improved if grey-level errors in the green channel are given a greater weight than those in the red or blue channels according to the eyes sensitivity to each. In embodiments this results in improved image quality for the same sub-frame compression, or improved sub-frame compression (and hence improved lifetime) for the same image quality.

Figure 13A:
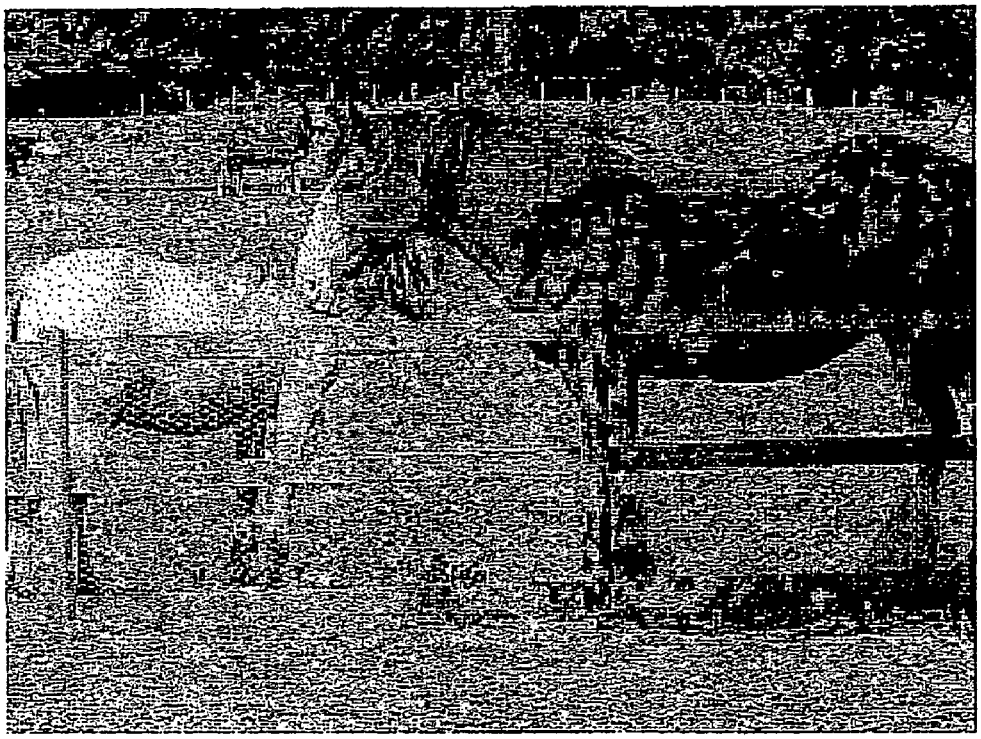
FIGS. 13*a-d* show, respectively, an original colour image (in monochrome), the image with 50% noise in the red channel, the image with 50% noise in the green channel, and the image with 50% noise in the blue channel.
Figure 13B:
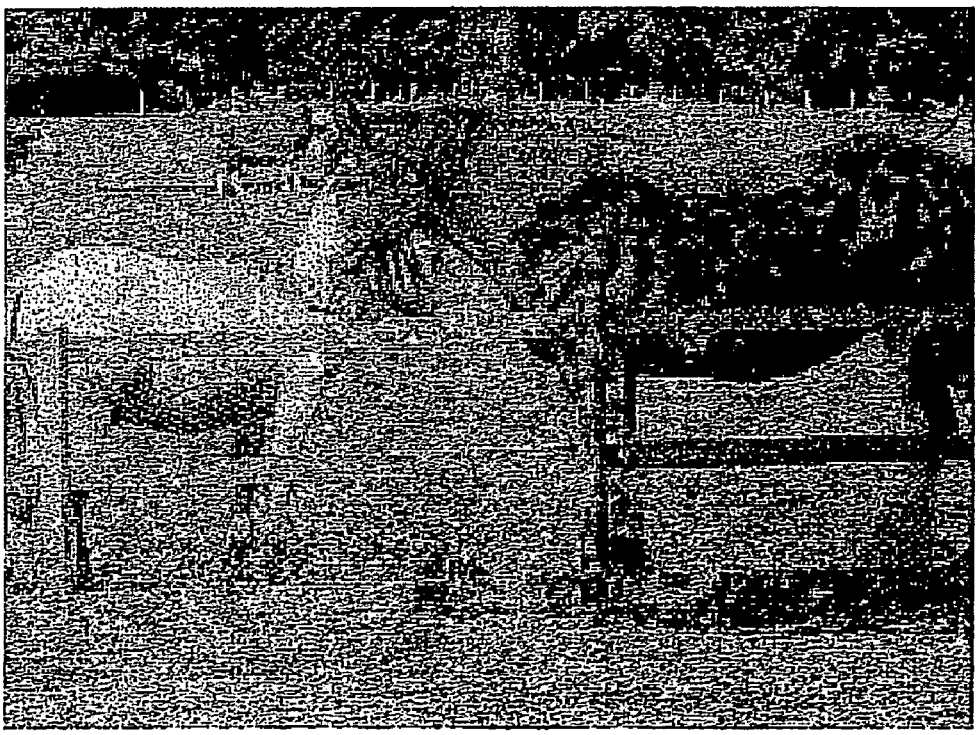
Figure 13C:
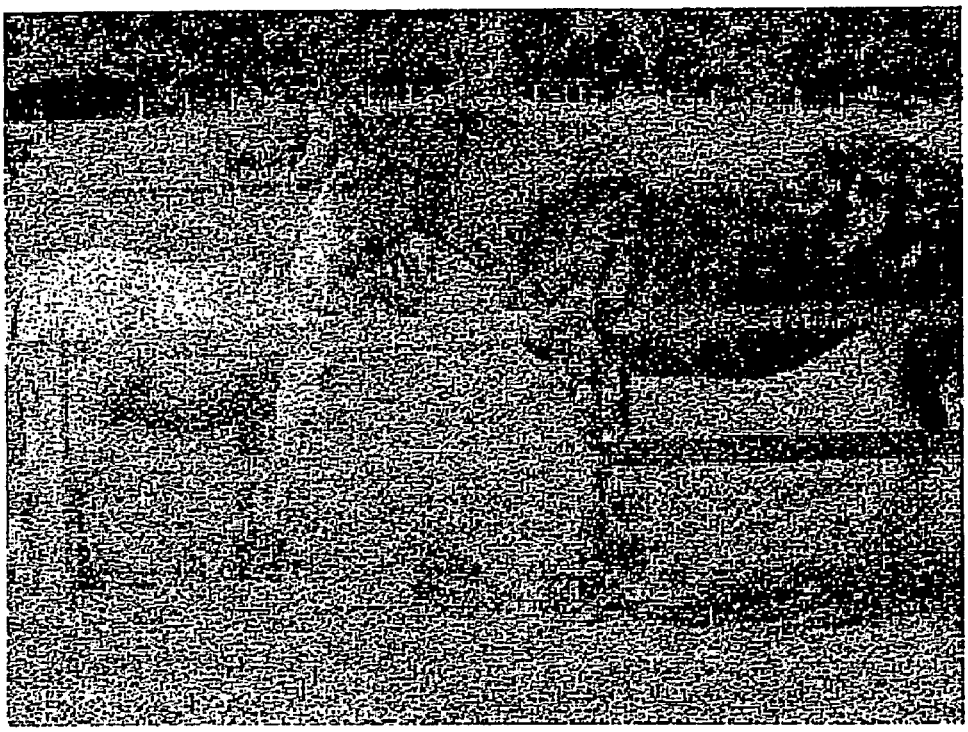
Figure 13D:
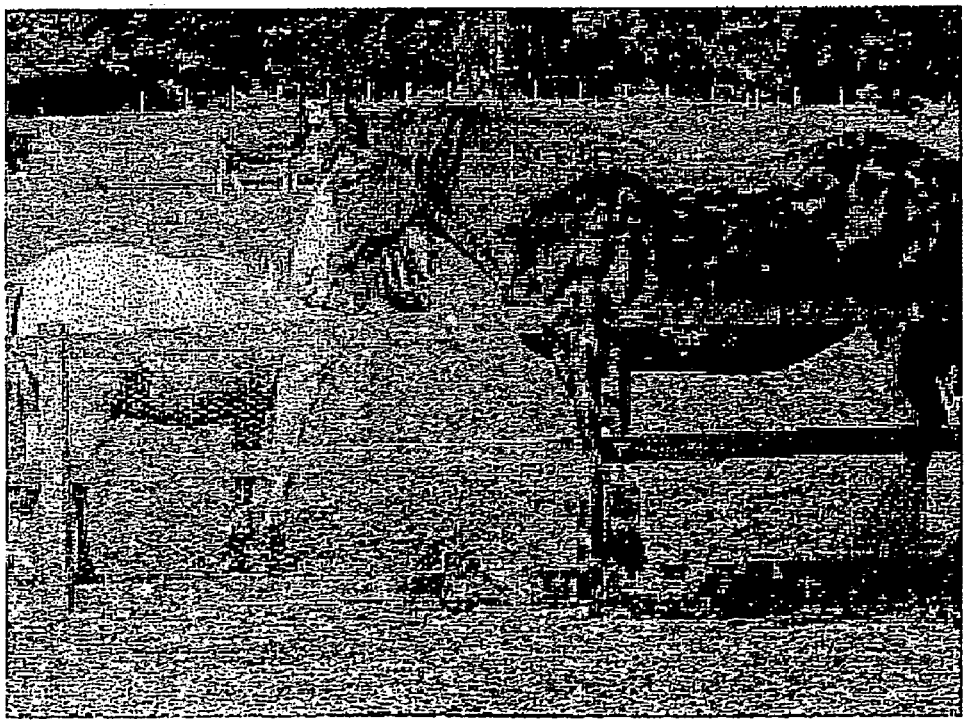

FIGS. 13*a-d* help to illustrate this effect, FIG. 13*a* showing an original image, FIG. 13*b* the image with 50% noise in the red channel, FIG. 13*c* the image with 50% noise in the green channel, and FIG. 13*d* the image with 50% noise in the blue channel. It can be seen that noise in the green has a much greater impact on image quality than noise in the blue or red. In all cases 50% average noise (that it, up to 50% error in grey level, uniformly distributed over the image) was applied to the single colour channel.

Figure 14:
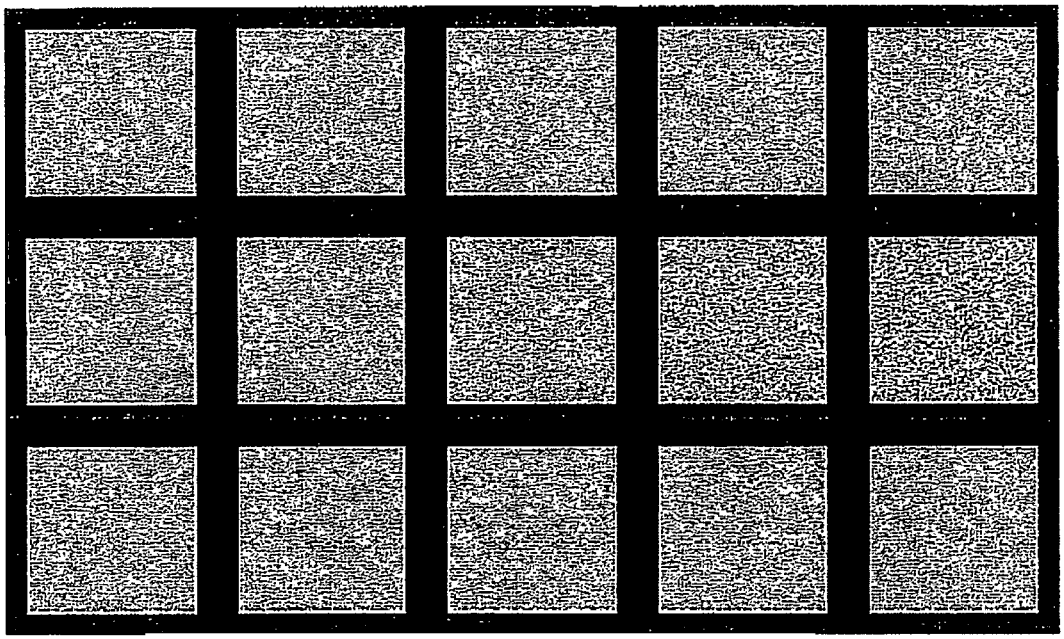
FIG. 14 shows a red-green-blue noise sampler illustrating the effect of increasing noise in red, green and blue colour channels, the first, second and third rows respectively.

Another example of the effect is illustrated in FIG. 14. This shows an RBG noise sampler in which the first row shows the visual effect of increasing noise in the red channel, the second row increasing noise in the green channel, and the third row increasing noise in the blue channel. The noise levels in FIG. 14, from left to right, are 0%, 10%, 20%, 30%, 40%. Thus modification of above described MLA algorithms to preferentially preserve a low noise in the green channel over the red and blue will result in improved image quality.

How this is implemented depends on the merit function which an MLA algorithm uses to obtain the optimised solution. For example, in the case of Euclidean distance minimisation each iteration is attempting to minimise the absolute difference between the target image and the current MLA solution.

For a case where the red green and blue pixels are always driven along dedicated lines, i.e. in a typical display where RGB sub-pixels are aligned along column stripes, one column signal is always driving just a single sub-pixel colour. In this case, a simple implementation of the concept is to scale the target pixel grey (ie colour luminance) levels by the sub-pixel relative luminances, that is by first, second and third weights for red, green and blue. For example for PAL primaries the green signal may be multiplied by 0.6, the red by 0.3 and the blue by 0.1. The procedure can then, for example, apply an Euclidean distance minimisation MLA algorithm to this modified image (a number of examples are described in UK patent application no. 0428191.1 and in applications derived from this (the contents of which are hereby incorporated by reference). Once a solution has been obtained the RGB column data can then be divided by the inverses of the multiplier which were previously applied (i.e. 1/0.6 for green, 1/0.3 for red and 1/0.1 for blue), prior to feeding these drive levels to the column drivers.

The various above-described image manipulation calculations to be performed are not dissimilar in their general character to operations performed by consumer electronic imaging devices such as digital cameras and embodiments of the method may be conveniently implemented in such devices.

In other embodiments the method can be implemented on a dedicated integrated circuit, or by means of a gate array, or in the software on a digital signal processor (DSP), or in some combination of these.

As previously mentioned embodiments of the above described techniques are applicable to both emissive displays such as LED-based displays, and to non-emissive displays such as LCD-based displays.

In the particular context of LED-based displays, the TMA schemes described have pulsed width modulated column drive (time control) on one axis and current division ratio (current control) on the other axis. For inorganic LEDs voltage is proportional to logarithm current (so a product of voltages is given by a sum of the log currents), however for OLEDs there is a quadratic current-voltage dependence. In consequence when the above described techniques are used to drive OLEDs it is important that PWM is employed. This is because even with current control there is a characteristic which defines the voltage across a pixel required for a given current and with only current control the correct voltage for each pixel of a subframe cannot necessarily be applied. The TMA schemes described nonetheless work correctly with OLEDs because rows are driven to achieve the desired current and columns are driven with a PWM time, in effect decoupling the column and row drives, and hence decoupling the voltage and current variables by providing two separate control variables.

Referring again to the NMF factorisation of an image matrix, some particularly preferred fast NMF matrix factorisation techniques are described in the Applicant's co-pending UK patent application no. 0428191.1, filed 23 Dec. 2004, the contents of which are hereby incorporated by reference in their entirety.

Some further optimizations are as follows:

Because current is shared between rows, if the current in one row increases the current in the rest reduces, so preferably (although this is not essential) the reference current and subframe time are scaled to compensate. For example, the subframe times can be adjusted with the aim of having the peals pixel brightness in each subframe equal (also reducing worst-case/peak-brightness aging). In practice this is limited by the shortest selectable sub-frame time and also by the maximum column drive current, but since the adjustment is only a second order optimisation this is not a problem.

Later sub-frames apply progressively smaller corrections and hence they tend to be overall dimmer whereas the earlier sub-frames tend to be brighter. With PWM drive, rather than always have the start of the PWM cycle an "on" portion of the cycle, the peak current can be reduced by randomly dithering the start of the PWM cycle. In a straightforward practical implementation a similar benefit can be achieved with less complexity by, where the off-time is greater than 50%, starting the "on" portion timing for half the PWM cycles at the end of the available period. This is potentially able to reduce the peak row drive current by 50%.

With rows comprising red (R), green (G) and blue (B) (sub-)pixels (i.e. an RGB, RGB, RGB row pattern), because each (sub-)pixel has different characteristics a given voltage applied to a row may not achieve the exact desired drive currents for each differently coloured OLED (sub-)pixel. It is therefore preferable to use an OLED display with separately driveable rows of red, green and blue (sub-)pixels (i.e. groups of three rows with respective RRRR . . . , GGGG . . . and BBBB . . . patterns). The advantages of such a configuration in relation to ease of manufacture have already been mentioned above.

Embodiments of the invention have been described with specific reference to OLED-based displays. However the techniques described herein are also applicable to other types of emissive display including, but not limited to, vacuum fluorescent displays (VFDs) and plasma display panels (PDPs) and other types of electroluminescent display such as thick and thin (TFEL) film electroluminescent displays, for example iFire® displays, large scale inorganic displays and passive matrix driven displays in general, as well as (in embodiments) to LCD displays and other non-emissive technology.

No doubt many other effective alternatives will occur to the skilled person. It will be understood that the invention is not limited to the described embodiments and encompasses modifications apparent to those skilled in the art lying within the spirit and scope of the claims appended hereto.

What is claimed is:

1. A method of driving an organic light emitting diode display, the display having a plurality of pixels each addressable by a row electrode and a column electrode, the method comprising:

receiving image data for display, said image data defining an image matrix;

factorising said image matrix into a product of at least a first factor matrix and a second factor matrix, said first factor matrix defining row drive signals for said display, said second factor matrix defining column drive signals for said display, wherein said factorising comprises calculating values of said first factor matrix and calculating values of said second factor matrix; and driving said display row and column electrodes using said row and column drive signals respectively defined by said first and second factor matrices, said driving comprising driving a said pixel of said display using a said row drive signal defined by said first factor matrix and simultaneously a said column drive signal defined by said second factor matrix, wherein said factorising comprises non-negative matrix factorisation (NMF), and wherein said driving comprises driving a plurality of said row electrodes simultaneously with a plurality of said column electrodes to thereby build up a luminescence profile over a plurality of row scan periods.

2. A method as claimed in claim 1 wherein said driving comprises driving a plurality of said row electrodes in combination with a plurality of said column electrodes.

3. A method as claimed in claim 1, wherein said driving comprises driving said display with successive sets of said row and column signals to build up a display image, each said set of signals defining a subframe of said display image, said subframes combining to define said display image.

4. A method as claimed in claim 3 wherein a number of said subframes is no greater than the smaller of a number of said row electrodes and a number of said column electrodes.

5. A method as claimed in claim 4 wherein said number of subframes is less than the smaller of a number of said row electrodes and a number of said column electrodes.

6. A method as claimed in claim 3, wherein said first factor matrix has dimensions determined by a number of said row electrodes and a number of said subframes, and wherein said second factor matrix has dimensions determined by a number of said column electrodes and said number of subframes.

7. A method as claimed in claim 1, wherein said display comprises a multicolour display, each said pixel of which comprises subpixels of at least a green colour and a second colour, wherein said image data includes colour data defining green and second colour channels for driving said green and second colour subpixels, and wherein said image matrix factorising includes weighting said green colour channel with a greater weight than said second colour channel such that said green channel is displayed on average more accurately than said second colour channel.

8. A method as claimed in claim 7 further comprising scaling said colour data for said green and second colour channels by respective first and second weights prior to said factorisation, and wherein said second weight is less than said first weight.

9. A method as claimed in claim 7 wherein said second colour is red and wherein each said pixel further comprises a blue subpixel; wherein said colour data includes data for a blue colour channel; and wherein said factorising includes weighting said green colour channel with a greater weight than said red and blue colour channels.

10. A method of driving an organic light emitting diode display, the display having a plurality of pixels each addressable by a row electrode and a column electrode, the method comprising:

receiving image data for display, said image data defining an image matrix;

factorising said image matrix into a product of at least a first factor matrix and a second factor matrix, said first factor matrix defining row drive signals for said display, said second factor matrix defining column drive signals for said display, wherein said factorising comprises calculating values of said first factor matrix and calculating values of said second factor matrix; and driving said display row and column electrodes using said row and column drive signals respectively defined by said first and second factor matrices, said driving comprising driving a said pixel of said display using a said row drive signal defined by said first factor matrix and simultaneously a said column drive signal defined by said second factor matrix, wherein said first and second factor matrices are configured such that a peak pixel brightness of said display is reduced compared with a row-by-row driving of said display using said image data, and wherein said factorising comprises non-negative matrix factorisation (NMF), and wherein said driving comprises driving a plurality of said row electrodes simultaneously with a plurality of said column electrodes to thereby build up a luminescence profile over a plurality of row scan periods.

11. A method of driving an organic light emitting diode display, the display having a plurality of pixels each addressable by a row electrode and a column electrode, the method comprising:

receiving image data for display, said image data defining an image matrix;

factorising said image matrix into a product of at least a first factor matrix and a second factor matrix, wherein said factorising comprises calculating values of said first factor matrix and calculating values of said second factor matrix, said first factor matrix defining row drive signals for said display, said second factor matrix defining column drive signals for said display, wherein said image matrix comprises an m×n (row×column) matrix I and said first and second factor matrices respectively comprise an m×p (row×column) matrix W and a p×n (row×column) matrix H where p is less than or equal to the smallest of n and m and where $I \approx W \cdot H$; and driving said display row and column electrodes using said row and column drive signals respectively defined by said first and second factor matrices, said driving comprising driving a said pixel of said display using a said row drive signal defined by said first factor matrix and simultaneously a said column drive signal defined by said second factor matrix, wherein said factorising comprises non-negative matrix factorisation (NMF) and wherein said driving comprises driving a plurality of said row electrodes simultaneously with a plurality of said column electrodes to thereby build up a luminescence profile over a plurality of row scan periods.

12. A non-transitory carrier medium carrying a processor control code for receiving image data for display by an organic light emitting display, said image data defining an image matrix; factorising said image matrix into a product of at least a first factor matrix and a second factor matrix, wherein said factorising comprises calculating values of said first factor matrix and calculating values of said second factor matrix, said first factor matrix defining row drive signals for said display, said second factor matrix defining column drive signals for said display; and driving said display row and column electrodes using said row and column drive signals respectively defined by said first and second factor matrices, said driving comprising driving a said pixel of said display using a said row drive signal defined by said first factor matrix and simultaneously a said column drive signal defined by said second factor matrix, wherein said factorising comprises non-negative matrix factorisation, and wherein said driving comprises driving a plurality of said row electrodes simultaneoulsy with a plurality of said column electrodes to thereby build up a luminescence profile over a plurality of row scan periods.

13. A driver for an emissive display, the display having a plurality of pixels each addressable by a row electrode and a column electrode, the driver comprising;

an input for receiving image data for display, said image data defining an image matrix;

a system for factorising said image matrix into a product of at least a first factor matrix and a second factor matrix, said first factor matrix defining row drive signals for said display, said second factor matrix defining column drive signals for said display, wherein said factorising comprises calculating values of said first factor matrix and calculating values of said second factor matrix; and output means to output said row and column drive signals respectively defined by said first and second factor matrices, said outputting for driving a pixel using a said row drive signal defined by said first factor matrix and simultaneously a said column drive signal defined by said second factor matrix, and wherein all the elements of said first and second factor matrices are equal to or greater than zero and when said display is driven by said drive signals a plurality of said row electrodes is driven simultaneously with a plurality of said column electrodes to thereby build up a luminescence profile over a plurality of row scan periods.

14. A method of driving an organic light emitting diode display, the display having a plurality of pixels each addressable by a row electrode and a column electrode, the method comprising:

receiving image data for display, said image data defining an image matrix;

formatting said image data into a plurality of subframes, each said subframe comprising data for driving a plurality of said row electrodes simultaneously with a plurality of said column electrodes; and driving said row and column electrodes with said subframe data, wherein said subframe data driving said row and column electrodes comprises only positive or zero data, wherein said formatting comprises compressing said image data into said plurality of subframes, and wherein said compressing comprises non-negative matrix factorisation (NMF), said non-negative matrix factorisation comprising factorising said image data into a product of at least a first factor matrix and a second factor matrix, wherein said factorising comprises calculating values of said first factor matrix and calculating values of said second factor matrix, said driving comprising driving a said pixel of said display using a said row drive signal defined by said first factor matrix and simultaneously a said column drive signal defined by said second factor matrix, wherein said driving comprises driving a plurality of said row electrodes simultaneously with a plurality of said column electrodes to thereby build up a luminescence profile over a plurality of row scan periods.

15. A method as claimed in claim 14 wherein said display comprises a multicolour display, wherein said image data comprises colour image data, and wherein said compressing comprises compressing data for a green colour channel of said display less than data for at least one of a red and a blue colour channel of said display.

16. A method as claimed in claim 14, wherein said formatting is configured to generate subframe data such that data from more than one said subframe enables driving a pixel of said display, whereby more than one said subframe contributes to an apparent brightness of pixels of the display.

17. A method as claimed in claim 14, wherein said display comprises a passive matrix organic light emitting diode display.

18. A method of driving an organic light emitting diode display, the display having a plurality of pixels each addressable by a row electrode and a column electrode, the method comprising:

receiving image data for display, said image data defining an image matrix in which rows and columns of the image matrix correspond to rows and columns of image pixels of the display, wherein said image data comprises an m×n (row×column) matrix I, wherein m is the number of rows and n is the number of columns of said display, and wherein said NMF determines a first m×p (row×column) matrix W and a p×n (row×column) matrix H where p is less than or equal to the smallest of n and m, and wherein $I \approx W \cdot H$;

formatting said image data in said image matrix into a plurality of subframes, each said subframe comprising data for driving a plurality of said row electrodes simultaneously with a plurality of said column electrodes; and driving said row and column electrodes with said subframe data, wherein said subframe data driving said row and column electrodes comprises only positive or zero data, wherein said formatting comprises compressing said image data into said plurality of subframes, and wherein said compressing comprises non-negative matrix factorisation (NMF) and wherein said driving comprises driving a plurality of said row electrodes simultaneously with a plurality of said column electrodes to thereby build up a luminescence profile over a plurality of row scan periods.

19. A non-transitory carrier medium carrying processor control code for receiving image data for display by an organic light emitting diode display;

formatting said image data into a plurality of subframes, each said subframe comprising data for driving a plurality of said row electrodes simultaneously with a plurality of said column electrodes; and driving said row and column electrodes with said subframe data, wherein said subframe data driving said row and column electrodes comprises only positive or zero data, and wherein said formatting comprises non-negative matrix factorisation (NMF), said non-negative matrix factorisation comprising factorising said image data into a product of at least a first factor matrix and a second factor matrix, wherein said factorising comprises calculating values of said first factor matrix and calculating values of said second factor matrix, said driving comprising driving a said pixel of said display using a said row drive signal defined by said first factor matrix and simultaneously a said column drive signal defined by said second matrix, and wherein said driving comprises driving a plurality of said row electrodes simultaneously with a plurality of said column electrodes to thereby build up a luminescence profile over a plurality of row scan periods.

20. A driver for an emissive display, the display having a plurality of pixels each addressable by a row electrode and a column electrode, the driver comprising:

an input to receive image data for display;

a system for formatting said image data into a plurality of subframes, each said subframe comprising data for driving a plurality of said row electrodes simultaneously with a plurality of said column electrodes, said formatting comprising factorising said image data into a product of at least a first factor matrix and a second factor matrix, wherein said factorising comprises calculating values of said first factor matrix and calculating values of said second factor matrix, said driving comprising driving a said pixel of said display using a said row drive signal defined by said first factor matrix and simultaneously a said column drive signal defined by said second factor matrix; and an output to output said subframe data for driving said row and column electrodes, and wherein said subframe data driving said row and column electrodes comprises only positive or zero data, and wherein said driving comprises driving a plurality of said row electrodes simultaneously with a plurality of said column electrodes to thereby build up a luminescence profile over a plurality of row scan periods.

21. A driver for an emissive display, the display having a plurality of pixels each addressable by a row electrode and a column electrode, the driver comprising:

an input to receive image data for display, said image data defining an image matrix;

an output to provide data for driving said row and column electrodes of said display;

data memory to store said image data;

program memory storing processor implementable instructions; and a processor coupled to said input, to said output, to said data memory and to said program memory to load and implement said instructions, said instructions comprising instructions for controlling the processor to:

input said image data;

factorise said image matrix into a product of at least first and second factor matrices said first factor matrix defining row drive signals for said display, said second factor matrix defining column drive signals for said display, wherein said factorising comprises calculating values of said first factor matrix and calculating values of said second factor matrix; and output said row and column drive signals respectively defined by said first and second factor matrices, said driving comprising driving a said pixel of said display using a said row drive signal defined by said first factor matrix and simultaneously a said column drive signal defined by said second factor matrix, and wherein all the elements of said first and second factor matrices are equal to or greater than zero and wherein said driving comprises driving a plurality of said row electrodes simultaneously with a plurality of said column electrodes to thereby build up a luminescence profile over a plurality of row scan periods.

22. A driver for an emissive display, the display having a plurality of pixels each addressable by a row electrode and a column electrode, the driver comprising:

an input to receive image data for display, said image data defining an image matrix;

an output to provide data for driving said row and column electrodes of said display; data memory to store said image data;

program memory storing processor implementable instructions; and a processor coupled to said input, to said output, to said data memory and to said program memory to load and implement said instructions, said instructions comprising instructions for controlling the processor to:

input said image data;

format said image data into a plurality of subframes, each said subframe comprising data for driving a plurality of said row electrodes simultaneously with a plurality of said column electrodes, said formatting comprising factorising said image data into a product of at least a first factor matrix and a second factor matrix, wherein said factorising comprises calculating values of said first factor matrix and calculating values of said second factor matrix; and output said subframe data for driving said row and column electrodes, said outputting for driving a pixel using a said row drive signal defined by said first factor matrix and simultaneously a said column drive signal defined by said second matrix, and wherein said subframe driving said row and column electrodes comprises only positive or zero data, and wherein said driving comprises driving a plurality of said row electrodes simultaneously with a plurality of said column electrodes to thereby build up a luminescence profile over a plurality of row scan periods.

* * * * *

UNITED STATES PATENT AND TRADEMARK OFFICE

CERTIFICATE OF CORRECTION

PATENT NO. : 8,237,638 B2
APPLICATION NO. : 10/578786
DATED : August 7, 2012
INVENTOR(S) : Smith et al.

It is certified that error appears in the above-identified patent and that said Letters Patent is hereby corrected as shown below:

On page 2, under "Other Publication", in column 2, line 1, delete "nan-negative" and insert --non-negative--, therefor On page 2, under "Other Publication", in column 2, line 2, after "401", insert --,--, therefor On page 2, under "Other Publication", in column 2, line 8, delete "Pages." and insert --pages.--, therefor On page 2, under "Other Publication", in column 2, line 9, delete "Variable" and insert --variable--, therefor On page 2, under "Other Publication", in column 2, line 17, delete "Page." and insert --page.--, therefor On page 2, under "Other Publication", in column 2, line 18, before "International", insert --"--, therefor On page 2, under "Other Publication", in column 2, line 20, after "2007", insert --"--, therefor On page 2, under "Other Publication", in column 2, line 27, delete "10/578,659 ," and insert --10/578,659,--, therefor On page 2, under "Other Publication", in column 2, line 44, delete "maied" and insert --mailed--, therefor On page 3, under "Other Publication", in column 2, line 1-2, after "Opinion", insert --mailed--, therefor Signed and Sealed this
Eighth Day of January, 2013

David J. Kappos

David J. Kappos
*Director of the United States Patent and Trademark Office*

On page 3, under "Other Publication", in column 2, line 4, delete "1 Page, Mar. 17, 2006." and insert --Mar. 17, 2006, 1 page.--, therefor On page 3, under "Other Publication", in column 2, line 9, delete "[online}" and insert --[online]--, therefor In column 25, line 6, in Claim 9, after "subpixel;", insert --¶--, therefor In column 25, line 7, in Claim 9, after "; and", insert --¶--, therefor In column 25, line 65, in Claim 11, after "(NMF)", insert --,--, therefor In column 26, line 4, in Claim 12, after "matrix;", insert --¶--, therefor In column 26, line 12, in Claim 12, after "; and", insert --¶--, therefor In column 26, line 21, in Claim 12, delete "simultaneoulsy" and insert --simultaneously--, therefor In column 27, line 55, in Claim 19, after "for", delete "¶", therefor